US007686356B2

(12) United States Patent
Wilder et al.

(10) Patent No.: US 7,686,356 B2
(45) Date of Patent: Mar. 30, 2010

(54) UNIVERSAL DOOR STRIKER PLATE THAT PERMITS CONTINUOUS ADJUSTMENT

(76) Inventors: Winston Y. Wilder, 1528 Conner Dr., Dallas, TX (US) 75217; Greg Roach, 9499 Homestead La., Frisco, TX (US) 75034

( * ) Notice: Subject to any disclaimer, the term of this patent is extended or adjusted under 35 U.S.C. 154(b) by 0 days.

(21) Appl. No.: 11/485,001

(22) Filed: Jul. 12, 2006

(65) Prior Publication Data

US 2006/0249960 A1 Nov. 9, 2006

Related U.S. Application Data

(63) Continuation-in-part of application No. 11/293,004, filed on Dec. 2, 2005, now abandoned.

(60) Provisional application No. 60/633,118, filed on Dec. 3, 2004.

(51) Int. Cl.
*E05B 17/00* (2006.01)

(52) U.S. Cl. ..... 292/340; 292/341.15; 292/346

(58) Field of Classification Search ..... 292/340, 292/341.18, 341.19, 341.12, 341.15, 341.13
See application file for complete search history.

(56) References Cited

U.S. PATENT DOCUMENTS

| | | | | | |
|---|---|---|---|---|---|
| 1,111,425 | A | * | 9/1914 | Ziganek | 292/341.18 |
| 3,179,458 | A | * | 4/1965 | Sconzo | 292/341.15 |
| 3,245,709 | A | * | 4/1966 | Rosenberger | 292/341.13 |
| 4,183,568 | A | | 1/1980 | Ferracane | |
| D258,716 | S | | 3/1981 | Ciener | |
| 4,887,498 | A | | 12/1989 | Zayat | |
| 5,460,064 | A | * | 10/1995 | Zayat, Jr. | 81/185 |
| 5,613,718 | A | * | 3/1997 | Lin | 292/346 |
| 5,622,090 | A | | 4/1997 | Marks | |
| D385,762 | S | | 11/1997 | Marks | |
| 5,757,269 | A | * | 5/1998 | Roth et al. | 340/542 |
| 5,791,209 | A | | 8/1998 | Marks | |
| 6,085,465 | A | | 7/2000 | Olberding et al. | |
| 6,085,619 | A | | 7/2000 | Blake et al. | |
| 6,092,443 | A | | 7/2000 | Zayat et al. | |
| 6,581,991 | B2 | | 6/2003 | Galindo | |
| 6,637,298 | B1 | | 10/2003 | O'Brien et al. | |
| 6,837,527 | B1 | | 1/2005 | Laurenzana | |
| 6,843,458 | B1 | * | 1/2005 | Robinson et al. | 248/311.2 |
| 6,937,527 | B1 | | 8/2005 | Lotz et al. | |
| 7,011,348 | B2 | | 3/2006 | Milo | |

OTHER PUBLICATIONS

International Search Report and Written Opinion for PCT/US05/43814 dated Oct. 5, 2006.

* cited by examiner

*Primary Examiner*—Peter M Cuomo
*Assistant Examiner*—Kristina R Fulton
(74) *Attorney, Agent, or Firm*—Chainey P. Singleton; Daniel J. Chalker; Chalker Flores, LLP

(57) ABSTRACT

The present invention is an apparatus and method for increasing the security of a door latch that uses a striker plate having a striker plate housing with a side plate connected to the striker plate housing and extends generally parallel to the striker plate housing and at least one opening, one or more pins positioned slidably and toward an opening in the striker plate housing and a biasing mechanism in contact with the one or more pins for biasing each of the one or more pins toward the opening to conform to the shape of a throw bolt inserted into the opening.

14 Claims, 22 Drawing Sheets

UNIVERSAL DOOR STRIKER PLATE THAT PERMITS CONTINUOUS ADJUSTMENT

CROSS-REFERENCE TO RELATED APPLICATIONS

This application is a continuation-in-part and claims priority based on U.S. patent application Ser. No. 11/293,004, filed Dec. 2, 2005, which claims priority to U.S. Provisional Application Ser. No. 60/633,118, filed Dec. 3, 2004, the contents of each of which are incorporated by reference herein in their entireties. Without limiting the scope of the invention, its background is described in connection with door hardware, as an example.

TECHNICAL FIELD OF THE INVENTION

The present invention relates generally to door hardware, and in particular, to an adjustable door striker plate that does not require continuous adjustment.

BACKGROUND OF THE INVENTION

A conventional doorframe includes a door passageway, which is typically made of a pair of studs (e.g., wooden 2 by 4 studs nailed together or metal studs) covered by a casing made of ¾ of an inch boards, or metal casings in many commercial applications, forming a door jam. The door is hinged on one side of the housing with a doorknob and a door latch on the other side. The doorjamb leaves tight tolerances on all sides providing little space between the door and the door jam, yet still allows the door to function freely.

The door is secured into position with a door latch, which extends from the door and penetrates a hole, one-inch in diameter, in the casing and studs of the doorframe. The hole is aligned with the door latch and covered with a striker plate. The striker plate is generally 2 to 3 inches in length, made of metal and mortised and screwed into the casing of the door with ½ to ¾ of an inch long screws, which are easily stripped out. As a result of the tight tolerances and modification of the casing the installation of the striker plate is a customized operation. Therefore, the striker plate is difficult to reposition once it is installed. For the door and lock to function properly the door latch must fit into the hole of the striker plate. Misalignment of the door latch, the strike plate or both may result in serious security, health and safety risks in a door that will not close or open, latch or secure correctly.

As a consequence of age, humidity, foundation shifting and/or weather conditions buildings may move and cause doorframes to shift up and down and side to side. This movement results in misalignment of the relatively small hole of the striker plate and the door latch and/or the dead bolt latch. The misalignment often causes the door to be difficult or even impossible to secure. Additionally, the movement of the housing may result in the latch entering partially the striker plate and as a result may not adequately secure the door. In instances where the striker and door latch are semi-aligned, the interaction may be such that the friction is not sufficient to hold the door secure at such an imperfect position. In addition to the serious security problem caused by the misalignment, repeated attempts to reposition the striker plate may serious weaken the integrity of the doorframe and alter the aesthetic look of the door. Furthermore, even when the striker plate is moved, changes in conditions often cause the latch to return to its original position, causing the latch to misalign once again. Such changes are often observed and associated with changes in humidity.

One solution to the misalignment of the door latch and the hole of the striker plate includes the use of force (e.g., to pull the door up or push the door down or slam the door) to make the door latch and the striker plate hole align. Often doors that are forced to align result in doors that are just as difficult to reopen due to binding of the door, door latch, striker plate, or combination thereof. This problem is exacerbated when dealing with the elderly, children or the disabled, as they may not have the strength or the dexterity to supply the required force to align the door latch and striker plate hole. Furthermore, in times of emergency (e.g., a fire) a misaligned door and a lack of strength may preclude escape or cause the door to open during, e.g., a fire.

Other solutions to misalignments include adjusting the striker plate by redrilling the screw holes and remortising the striker plate to accommodate the new alignment position; most often resulting in the marring or destruction of the doorframe. Furthermore, reoccurring movement of the doorframe results in the process being repeated periodically, resulting in weak unsightly door jams.

The structure of a deadbolt latch and a door latch are quite different. The deadbolt has a larger diameter and a generally rectangular shape, which requires a matching striker plate hole. A door latch has a shorter, more rounded shape and corresponding striker plate. To further compound issues, some manufactures are designing door latches that incorporate the size and shape of the deadbolt latch. To change between these types new striker plates must be installed, which involves redrilling the screw holes and remortising the striker plate, often resulting in the marring or destruction of the doorframe.

The foregoing problems have been recognized for many years and while numerous solutions have been proposed, none of them adequately address all of the problems in a single device, e.g., multiple adjustments without reboring or remortising the doorjamb.

SUMMARY OF THE INVENTION

The present inventors recognized a need for a striker plate that would accommodate various vertical and horizontal alignments for receiving a door latch or a deadbolt latch, while eliminating the need to rebore the door jam and remortise the striker plate to correct misalignments.

In accordance with the present invention, a method and apparatus are provided that accommodate various vertical and horizontal alignments for receiving a throw bolt, a door latch, a deadbolt latch or any other securing mechanism. The present invention provides various vertical and horizontal alignment positions for receiving a throw bolt (e.g., door latch or a deadbolt latch), while eliminating the need to rebore the door jam and remortise the striker plate to correct misalignments.

For example, the present invention includes a striker plate having a striker plate housing with at least one opening, one or more pins positioned slidably and toward the opening of the striker plate housing and a biasing mechanism in contact with the one or more pins for biasing each of the one or more pins toward the opening to conform to the shape of a throw bolt inserted into the opening. The housing includes a side plate connected to the striker plate housing and extends generally parallel to the striker plate housing. In one embodiment, the pins form an array of pins.

The present invention also provides a method for securing a door including the steps of positioning a striker plate housing adjacent to a throw bolt and inserting the throw bolt into the striker plate. The striker plate housing includes a side plate connected to the striker plate housing and extends generally parallel to the striker plate housing and at least one opening, one or more pins positioned slidably and toward the opening of the striker plate housing and a biasing mechanism in contact with the one or more pins. The biasing mechanism biasing each of the one or more pins toward the opening to conform to the shape of a throw bolt inserted into the opening. When the throw bolt is inserted into the striker plate at least a portion of the one or more pins are depressed, whereby the throw bolt is retained.

The throw bolt may be of the general shape of a bolt, square, rectangle, oval or tube that may be inserted into the opening. For example, the throw bolt may include a throw bolt, dead bolt, circular bolt, dustless bolt, rod bolt, gate bolt, pin bolt, slide bolt, peg, rod, nail, pin, bolt array, pin array, array or a bolt. The throw bolt may be inserted into the opening and as a result forces one or more pins away from the throw bolt. The throw bolt may be hollow or partially hollow to allow one or more of the pins to penetrate the throw bolt. The present invention provides the use of various types of throw, bolts having different lengths, widths and shapes; as a result the present invention may dimensions that accommodate such a lengths, widths, depths and shapes. The dimensions of the present invention do not have to be proportional to the lengths, widths, depths or shape of the throw bolt. For example, the present invention may be 4 inches in depth for a 1 inch throw bolt; however, the present invention may be 1, 2, 3, 4, 5, 6, 7, 8, 9, 10 inches in lengths, widths, depths or combinations thereof. The present invention may also be varied by portion of inches for specific applications, e.g., ±0.1, 0.2, 0.3, 0.4, 0.5, 0.6, 0.7, 0.8, 0.9, 1.0.

The striker plate may be mounted to the door in many different manners depending on the particular application. The striker plate may be mounted as a conventional striker plates within the door casing, door jam and doorframe with screws bolts or other fasteners securing it in place. For other applications, the striker plate may be mounted behind the door casing and wall, with only the opening being exposed. The striker plate may be attached through screws into the studs of the frame or with fasteners through the housing and into the doorframe, whereby no fasteners are visible when installed. Additionally, the striker plate may be fitted into a receiving member attached to the doorframe or door jam designed to hold the striker plate, thus, allowing a pre-made aperture for the striker plate. Additionally, the present invention may be incorporated into a prefabricated stud or door jam or as part of a prefabricated insert. The striker plate may also be attached to the exterior of a surface, e.g., a gate, fence, or door, using, e.g., straps. The striker plate maybe attached using fasteners through the surface and into the back of the housing, providing added security through concealing the attachment mechanisms. In addition, the present invention may be attached to a plate attached to the door jam using a lip and groove, clip, a weld or bond or using similar mechanisms, e.g., the present invention snaps into a holder or striker plate that is then attached to the door. For example, the present invention may include a cover that extends around the doorjam covering a portion of the interior surface, exterior surface or both, whereby the cover provides additional protection and support. Other attachment mechanism that may be used including attachment straps, metal straps, epoxy, glue, welding or similar mechanism.

The present invention is also useful for placement on truck beds, commercial trailers, covered trailers, vehicle doors, hoods, storage building entrances and similar openings. The present invention may be inserted into the structure and positioned to allow a throw bolt to penetrate the opening and thus securing the enclosure.

One embodiment of the present invention is designed to fit a throw bolt; however, other embodiments are designed to fit more than one throw bolts. The housing may be extended to a size to accommodate throw bolts of different sizes, shapes and positions. The multiple throw bolts may be of the same type or of different types, having different widths, lengths, compositions, and the like.

The one or more pins of the present invention include an elongated middle portion and a first and second end, wherein one or more retaining mechanisms are positioned at a first end, a second end, in the middle portion, or combinations thereof, of each of the one or more pins. The one or more pins may individually be similar or different in size, shape, composition or texturing. The one or more pins may have a cross section that is circular, oval, square, rectangular, triangular, polygonal or combinations thereof.

The present invention uses one or more pins positioned slidably and toward the opening of the striker plate housing. The one or more pins may be arranged generally parallel to each other and extend toward the opening at an angle of between about 0 to 90 degrees. The pin may have one or more regions for retaining the pin within the housing and a bias mechanism. In some embodiments, the bias mechanism is positioned between the one or more retaining mechanism portioned at one end of each of the one or more pins. The present invention provides a biasing mechanism in contact with the one or more pins. The biasing mechanism may include one or more bias mechanisms for each pin. One embodiment may have one or more bias mechanisms for the apparatus. The bias mechanism may also have redundant mechanism, multiple springs, multiple overlapping springs, different types of bias mechanisms in one housing or other configurations. The biasing mechanism may include a coiled compression spring, a coiled compression spring surrounding each of the one or more pins and the like. The bias, mechanism can be a compressible medium, an elastomeric medium, a resilient medium or combinations thereof.

The housing of the present invention may have one or more cavities, tunnels, grooves, sheaths, coverings or other mechanism to separate some or all of the one or more pins from each other. The separation will minimize the interaction between pins that may cause failure. The cavity may extent into the housing away from the opening to accommodate the movement of the pin. In some embodiments, the bias mechanism may be positioned between the end of the pin and the cavity. In other embodiments, the bias mechanism may be positioned in contact with the middle of the pin. While in other embodiments, the pin and bias mechanism may both be positioned in multiple locations.

The present invention also includes a method of securing a door including positioning a striker plate housing having at least one opening, one or more pins positioned slidably and toward the opening of the striker plate housing and a biasing mechanism in contact with the one or more pins for biasing each of the one or more pins toward the opening to conform to the shape of a throw bolt inserted into the opening. The striker plate is positioned adjacent to a throw bolt and the throw bolt is inserted into the self-adjusting striker plate, wherein at least a portion of the one or more pins are depressed and the throw bolt is retained.

The present invention also includes a striker plate kit having a striker plate and one or more fasteners for securing the striker plate to a door jam. The striker plate includes a striker plate housing having at least one opening, a side plate connected to the striker plate housing that extends generally parallel to the striker plate housing, one or more pins positioned slidably and toward the opening of the striker plate housing, and a biasing mechanism in contact with the one or more pins for biasing each of the one or more pins toward the opening to conform to the shape of a throw bolt inserted into the opening.

The present invention also provides a method of making a striker plate including creating one or more holes in a striker plate housing, positioning slidably and toward the opening of the striker plate housing and contacting the one or more pins with a biasing mechanism for biasing each of the one or more pins toward the opening of the striker plate housing.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The terminology used and specific embodiments discussed herein are merely illustrative of specific ways to make and use the invention and do not delimit the scope of the invention.

In accordance with the present invention, a method and apparatus are provided that allows self adjusting of a striker plate used for door latches, deadbolts and other latch type locking systems. The present invention provides self adjusting of a striker plate that allows the latch to align with the hole in the striker plate, while accounting for misalignments or movement without the need to adjusting the striker plate by redrilling the screw holes and remortising the striker plate to accommodate the new alignment position.

For example, the striker plate of the present invention is designed as a new or replacement striker plate that alleviates the need to adjusting the striker plate manually by redrilling the screw holes and remortising the striker plate to accommodate the new alignment position. The striker plate is designed to replace conventional door strikers in commercial, residential, storage units and any other area employing a bolt type locking system. The striker plate of the present invention has many embodiments depending on the particular application. One embodiment has a housing that is generally about one and a half inches in width and one and a half inches to two inches in height. The residential applications may have a housing that is generally circular with a diameter of about one to two inches although other designs may be used that accommodate both a door latch, a deadbolt or both.

A semicircular housing may be attached to the outside of a casing, on a commercial trailer or similar application. The sizes of the housing may be altered to accommodate multiple locks. Additionally, the mounting of the striker plate may be accomplished in a variety of ways. The striker plate of the present invention may have a conventional two-hole mounting system with screws penetrating the casing and the doorframe. Alternatively, a four-hole system may be used securing the apparatus at four locations in the casing and the doorframe.

Figure 1:
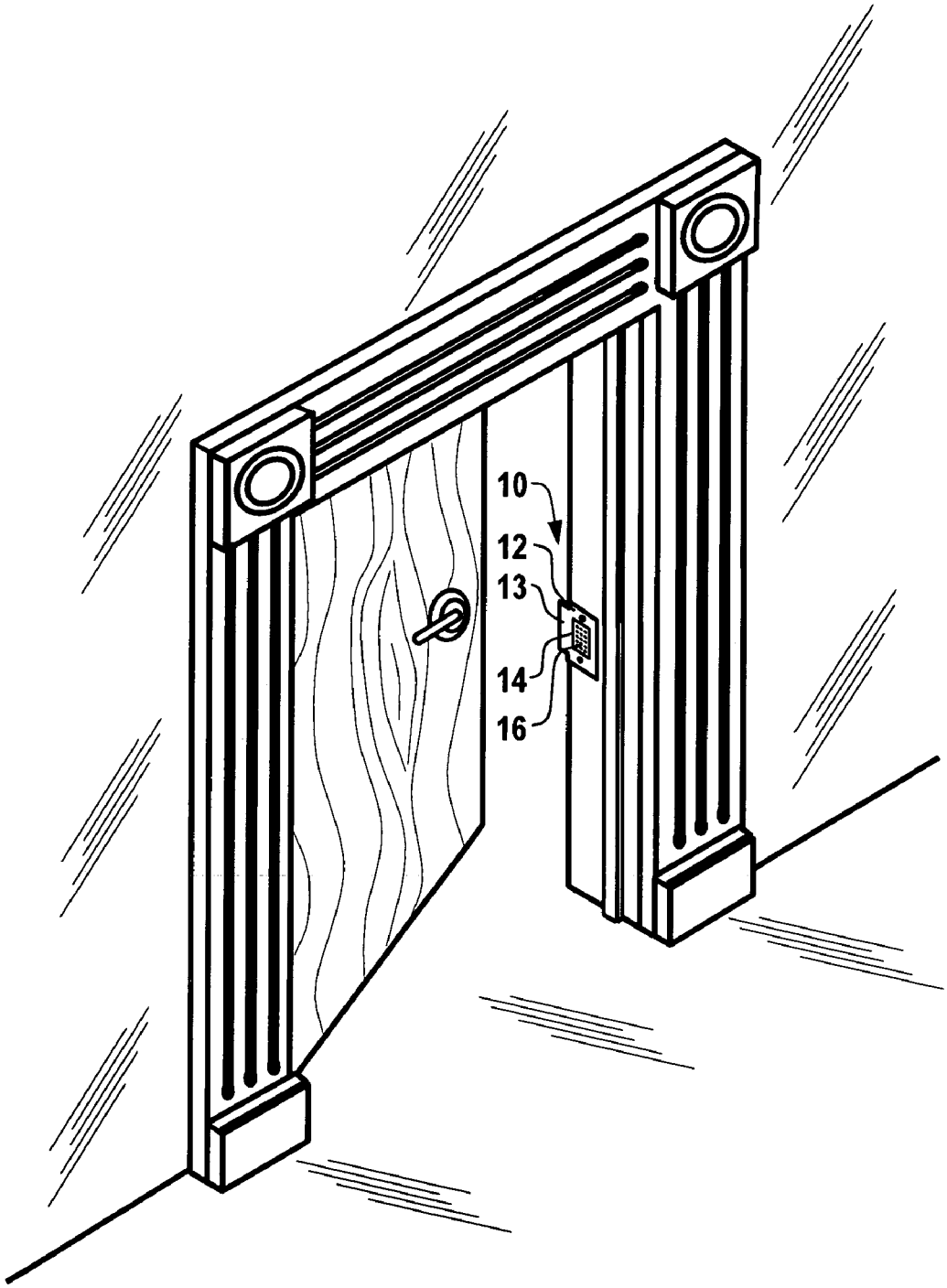
FIG. 1 illustrates certain features of a striker plate according to an embodiment of the present invention in operation.
Figure 2:
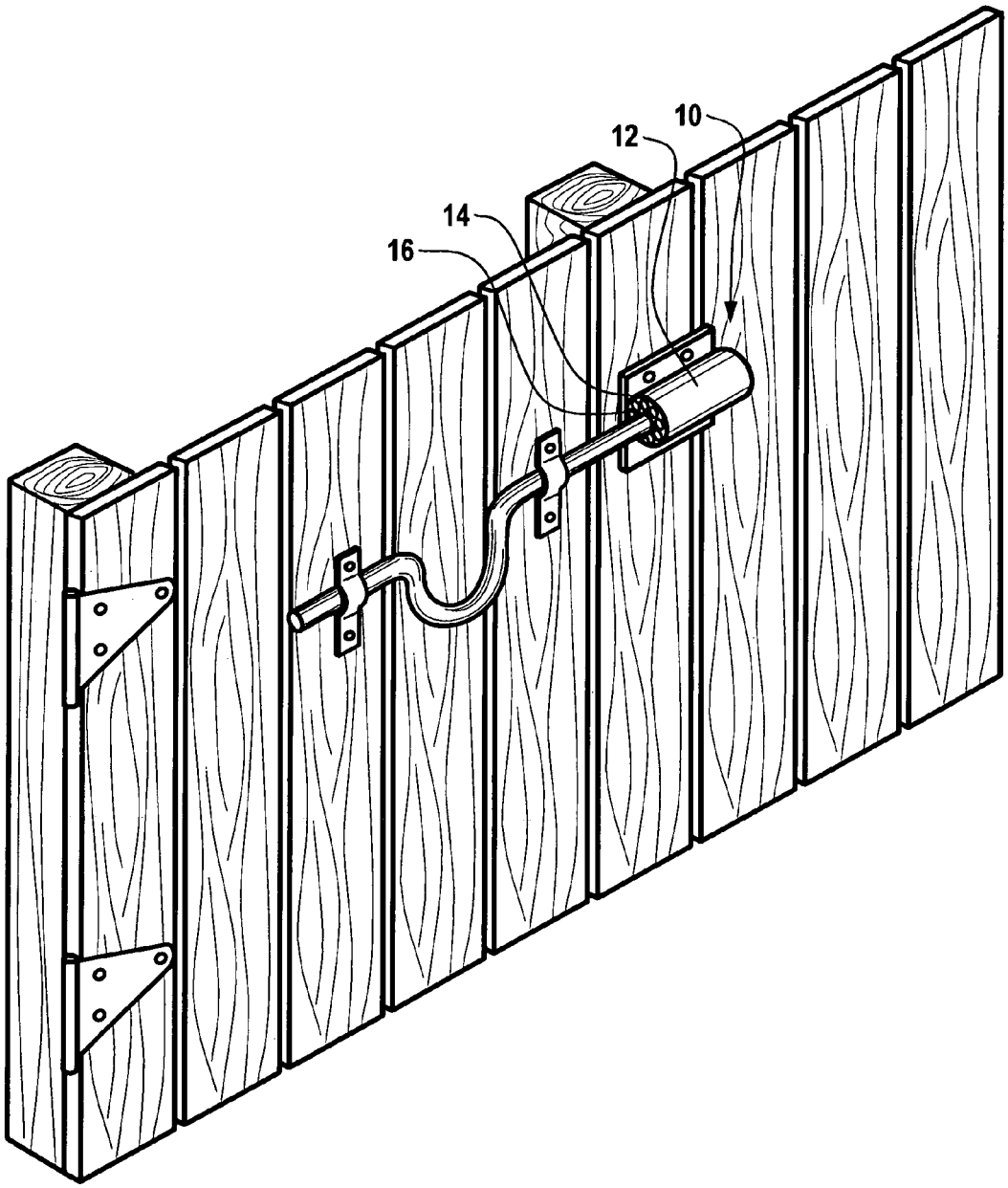
FIG. 2 is a view of another embodiment of the apparatus shown in FIG. 1 in use.
Figure 3:
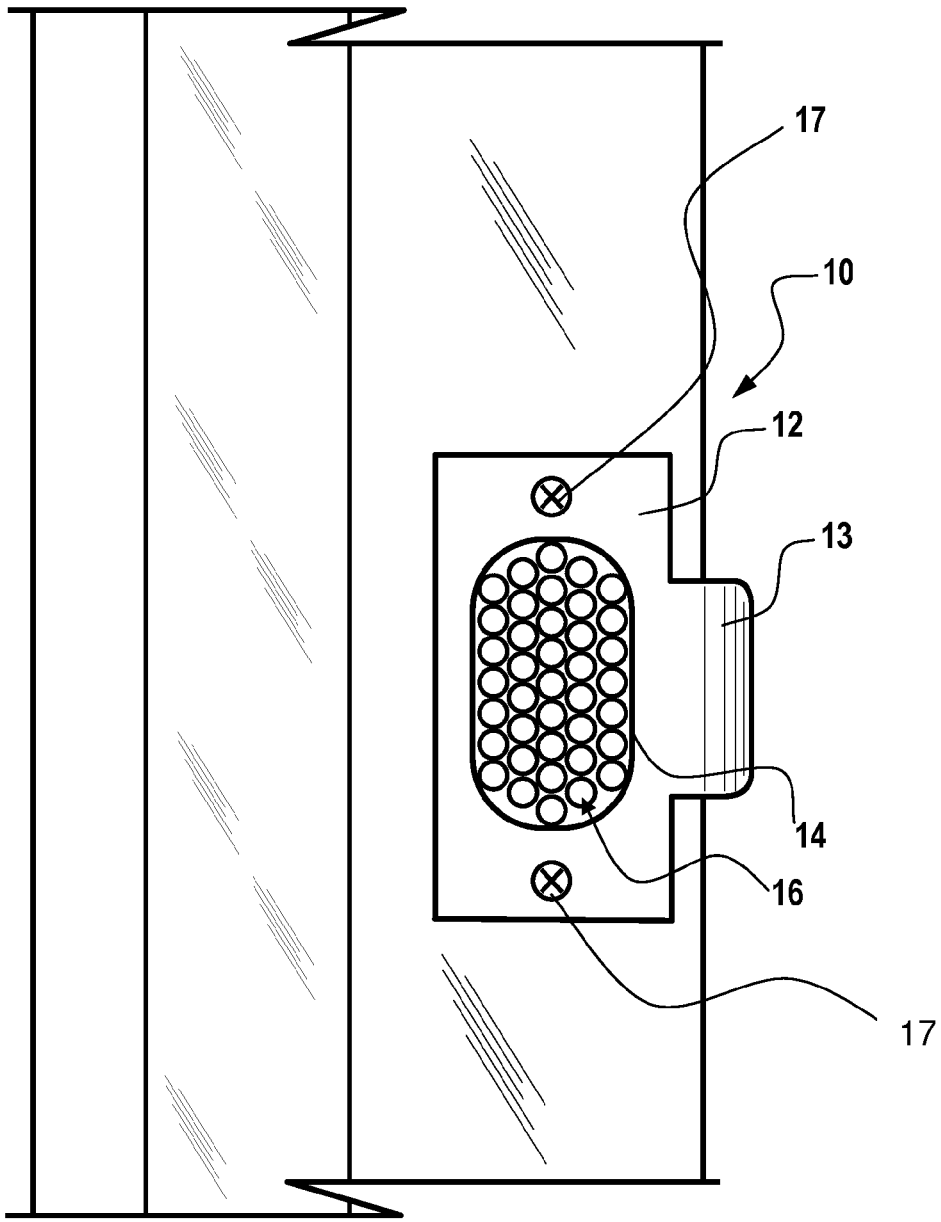
FIG. 3 is a view of certain features of the apparatus shown in FIG. 1.

With reference to FIGS. 1, 2 and 3 are views of different embodiments of the self-adjusting striker plate 10 in use. FIG. 1 depicts the striker plate 10 mounted internally in the doorframe of a conventional door opening. FIG. 2 depicts an external attachment of the self-adjusting striker plate 10 to a fence and gate opening. FIG. 3 is a view of one embodiment of the striker plate 10 mounted internally in the doorframe of a door opening. FIGS. 1, 2 and 3 include a housing 12 having an internal region (not shown) and an open end 14 exposing one or more pins 16. For example, the one or more pins 16 form a face of the open end 14 that is generally flush. A lip 13 is incorporated into the housing 12 at open end 14 and directs or pushes the latch toward the opening 14. The one or more pins 16 are packed generally in parallel, however, the arrangement of the pins may be in different configurations (e.g., staggered, spaced, alternating, etc.) depending on the specific application. The one or more pins 16 may be made different lengths, widths shapes and thicknesses depending on the requirements of the particular application. The striker plate 10 of FIG. 3 is mounted to the doors casing, door jam and doorframe with screws 17 to secure it in place.

Figure 4A:
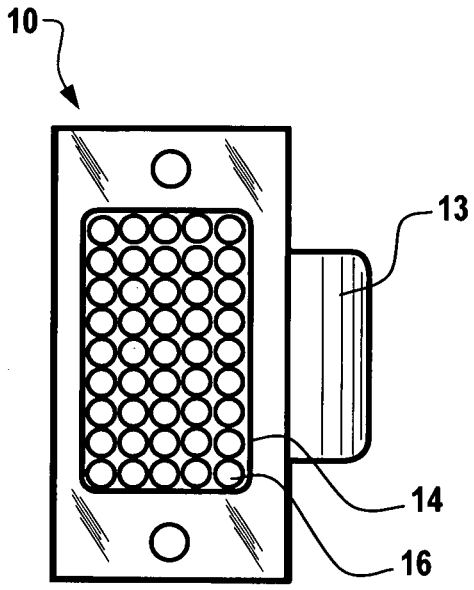
FIGS. 4*a-f* are front views of different embodiments of the apparatus shown in FIG. 1.
Figure 4B:
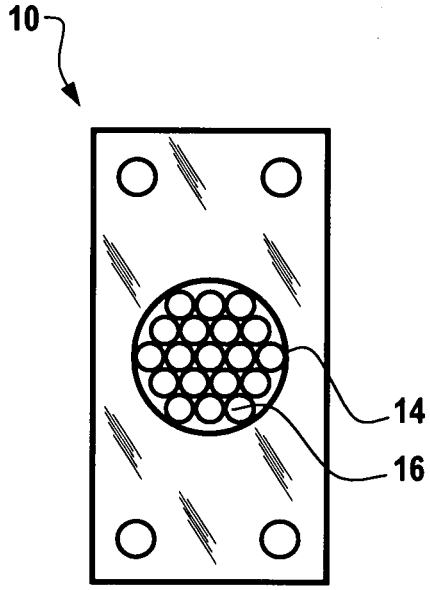
Figure 4C:
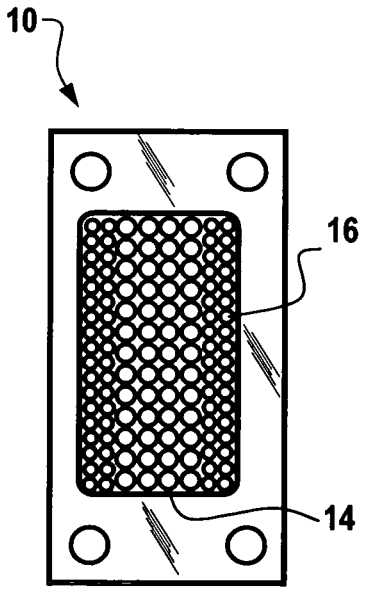
Figure 4D:
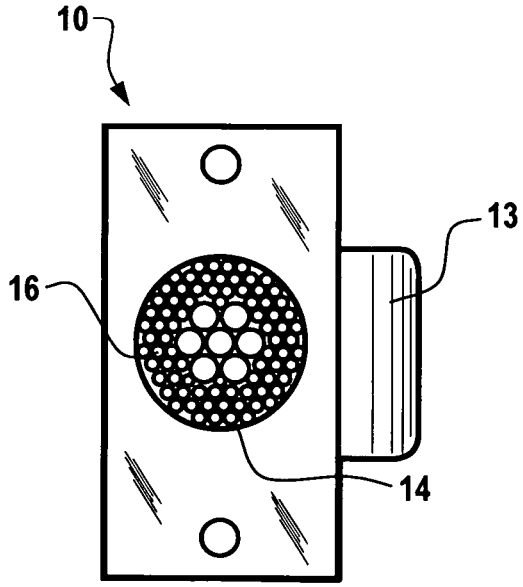
Figure 4E:
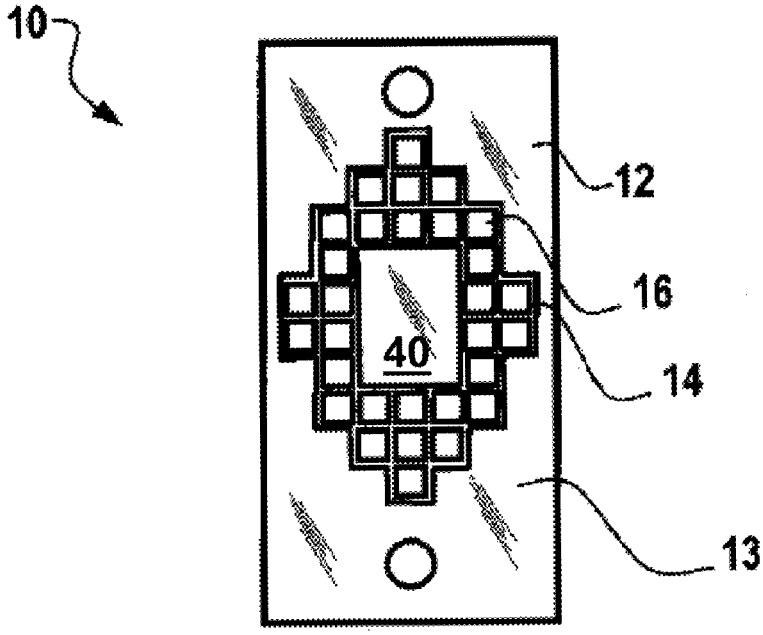
Figure 4F:
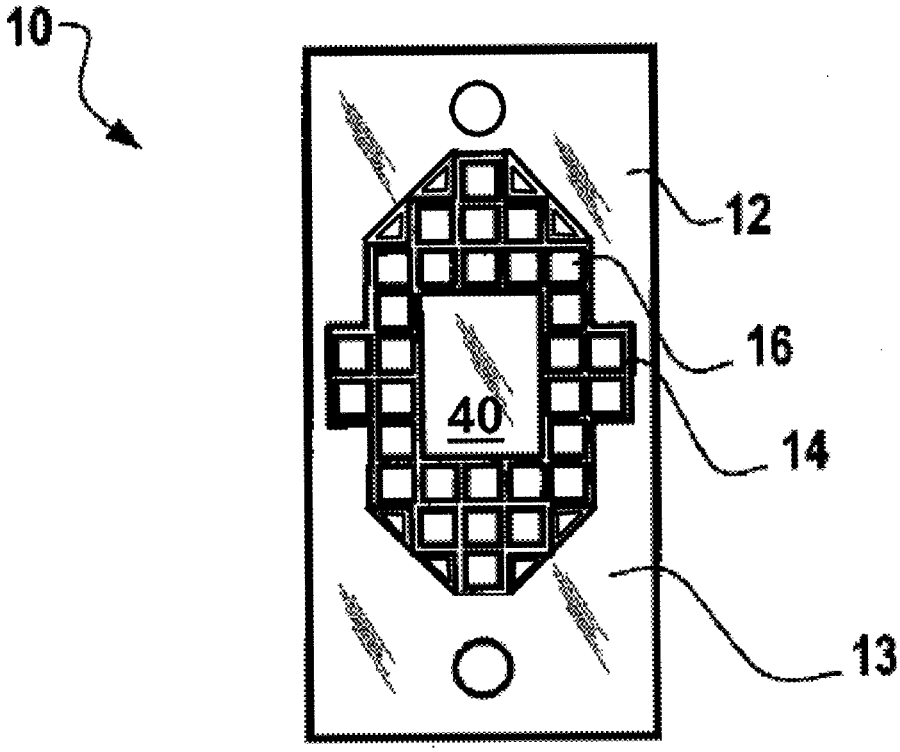

FIGS. 4*a*, 4*b*, 4*c* 4*d* , 4*e* and 4*f* are front views of different embodiments of the self-adjusting striker plate 10. The housing 12 has an open end 14 exposing one or more pins 16. A lip 13 is incorporated into the housing 12 at open end 14 and directs or pushes the latch toward the opening 14. FIG. 4*a* and FIG. 4*b* are front views of different embodiments of the striker plate 10 having one or more pins 16 made of different materials in the same striker plate 10. For example, steel may be used for the one or more pins 16 closer to the edge or the threshold to maximize their mechanical strength, whereas one or more pins 16 made of plastic may be used in the interior or middle portions to eliminate noise. FIG. 4*c* and FIG. 4*d* are front views of different embodiments of the striker plate 10 having one or more pins 16 of differing sizes. FIG. 4*e* and FIG. 4*f* are front views of different embodiments of the striker plate 10 having one or more pins 16 of differing sizes and illustrating polygonal openings 14.

Figure 5:
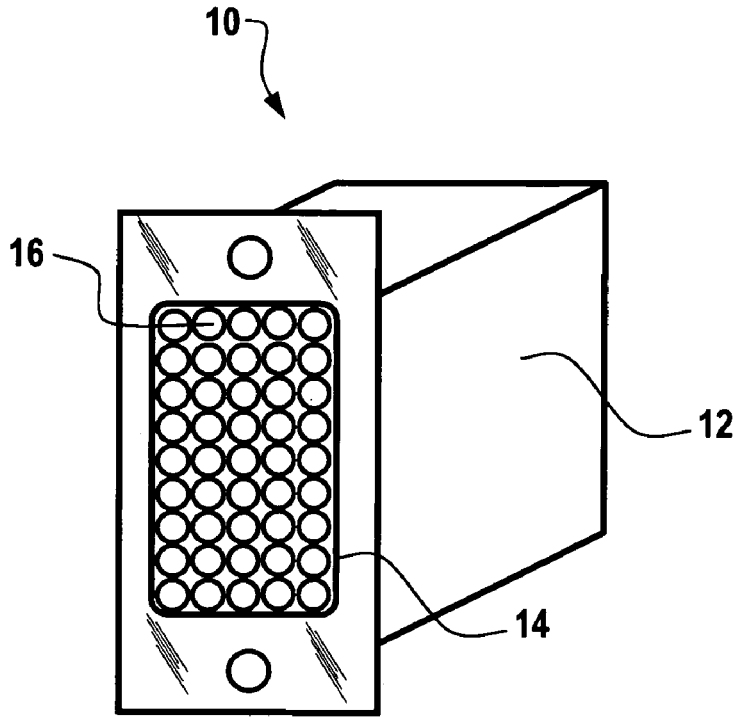
FIG. 5 is a perspective view that illustrates certain features of a striker plate shown in FIG. 1.
Figure 6:
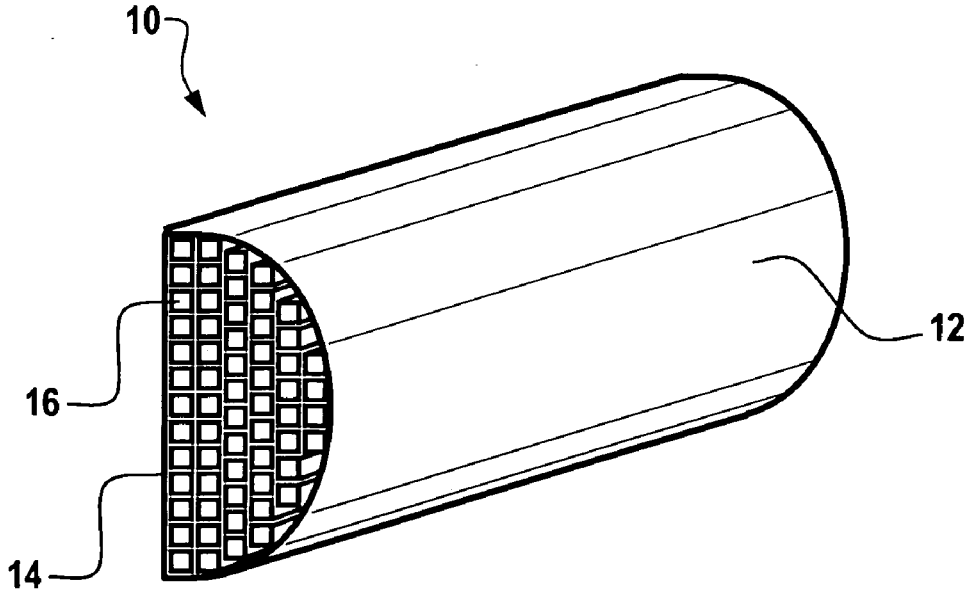
FIG. 6 is a perspective view that illustrates certain features of a striker plate according to another embodiment of the present invention.
Figure 7:
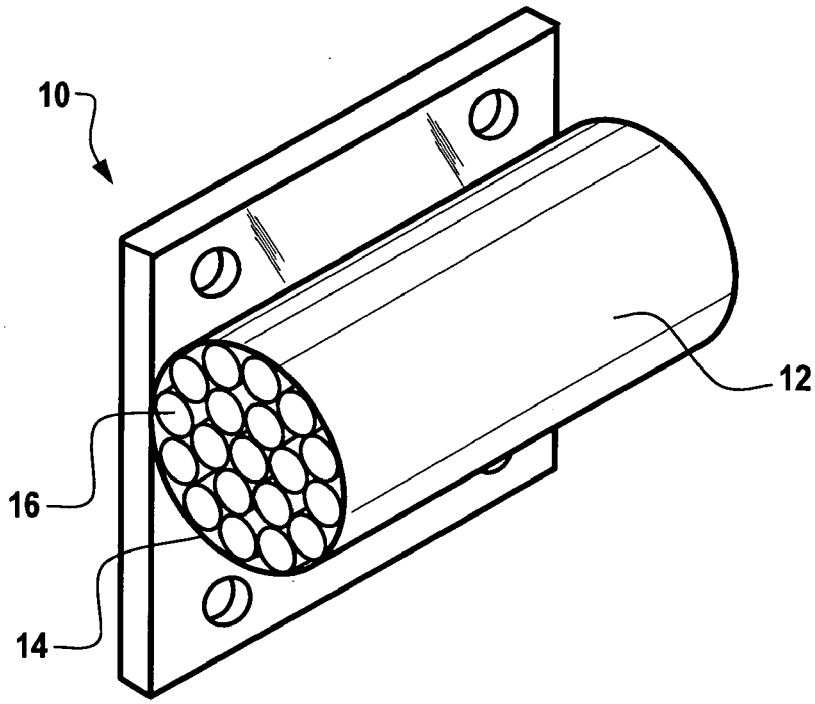
FIG. 7 is a perspective view that illustrates certain features of a striker plate according to yet another embodiment of the present invention.

With reference to FIGS. 5, 6 and 7 are perspective views of different embodiments of the striker plate 10. FIG. 5 is a perspective view of an internally mounted striker plate 10 of the present invention. FIG. 6 is a perspective view of an externally mounted striker plate 10, which attaches the housing 12 to a surface. FIG. 7 is a perspective view of an externally mounted self-adjusting striker plate 10 with external mounting straps. FIGS. 5, 6 and 7 are shown and include a housing 12 having an internal region (not shown) and an open end 14 exposing one or more pins 16. The one or more pins 16 are packed generally in parallel, however the arrangement of the pins may be in different configurations (e.g., staggered, spaced, alternating, etc.) depending on the specific application. The one or more pins 16 may be different lengths and thicknesses depending on the requirements of the particular application. The one or more pins 16 form a face of the open end 14 that is generally flush.

Figure 8:
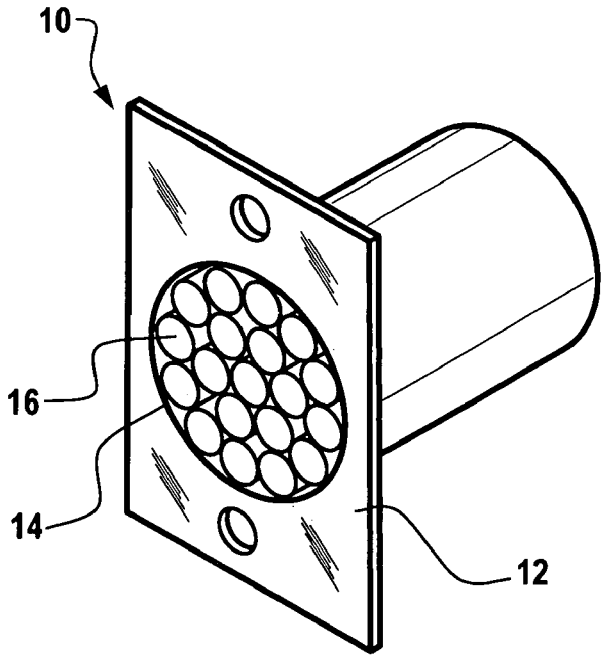
FIG. 8 is a front view of one embodiment of a portion of the apparatus shown in FIG. 1.
Figure 9:
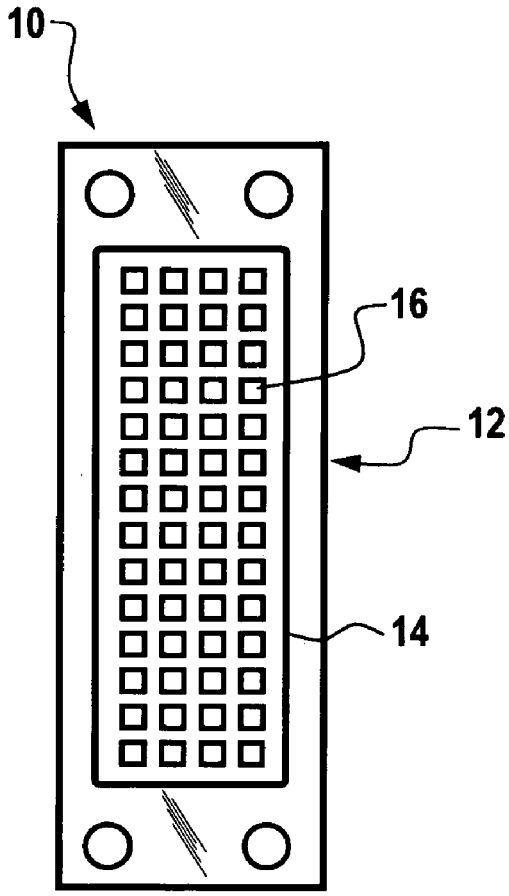
FIG. 9 is a front view of another embodiment of a portion of the apparatus shown in FIG. 1.
Figure 10:
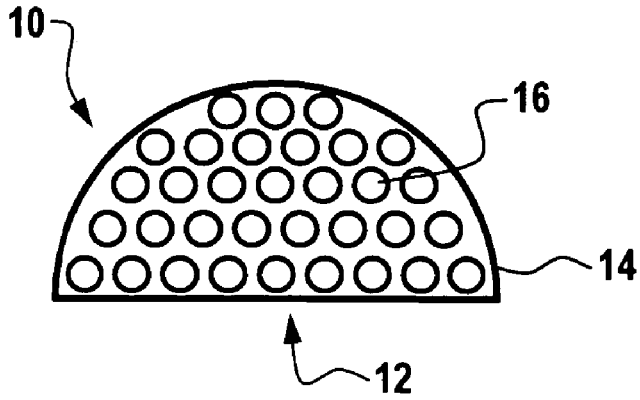
FIG. 10 is a front view of another embodiment of a portion of the apparatus shown in FIG. 1.

FIGS. 8, 9 and 10 are front views of different embodiments of the striker plate 10 shown if FIG. 1. FIG. 8 is an embodiment having a round opening at open end 14 with a lip 13 that directs or pushes the latch toward the opening 14. The striker plate 10 including the housing 12 having an open end 14 exposing one or more pins 16. The one or more pins 16 have a cross section that is generally circular. FIG. 9 is an embodiment having a square opening at open end 14. The striker plate 10 including the housing 12 having an open end 14 exposing one or more pins 16. The one or more pins 16 have a cross section that is generally rectangular. FIG. 10 is an embodiment having a partial round opening at open end 14. The striker plate 10 including the housing 12 having an open end 14 exposing one or more pins 16 having a cross section that is generally polygonal. The one or more pins 16 and the housing 12 may be made out of metals, alloys, polymers, plastics, wood or other suitable materials or combinations thereof.

With reference to FIGS 11*a*, 11*b*, 11*c* and 11*d* are side views of different embodiments of a portion of the apparatus 10 shown in FIG. 1. A representative pin of one of the one or more pins 16 of a striker plate (not shown) is illustrated. Each of the one or more pins 16 includes a shaft 18 having a middle portion 20, a first end 22 and a second end 24. The second end 24 may have a retaining mechanism 26. In some embodiments, the retaining mechanism 26 may be an enlargement of the second end 24 while other retaining mechanisms may include a removable mechanisms attached to the interior end 24, e.g., a cap, a plate, a notch, a bolt, a clip, a bulge or similar mechanism known in the art. The retaining mechanism 26 serves to retain each of the individual pins of the one or more pins 16 within the housing 12 and in some embodiments provides a coupling location for the bias mechanism (not shown).

Figure 11A:
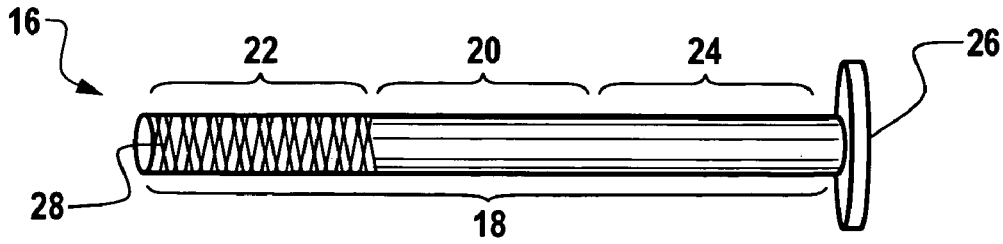
FIGS. 11*a-g* are side views of different embodiments of one pin of the apparatus shown in FIG. 1.
Figure 11B:
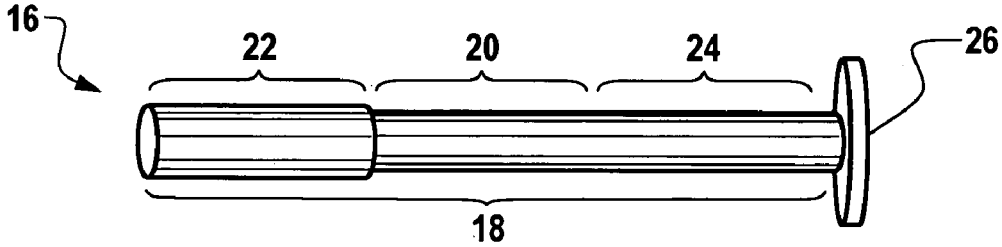
Figure 11C:
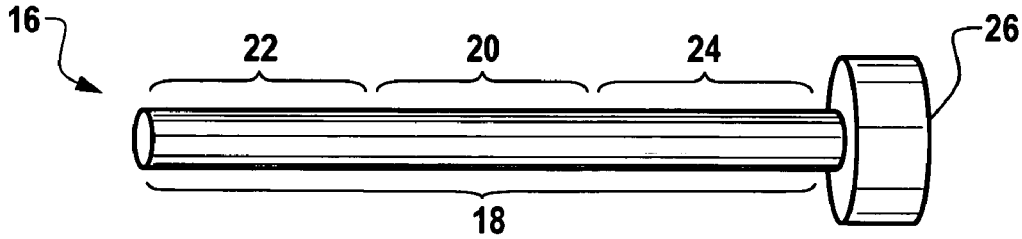
Figure 11D:
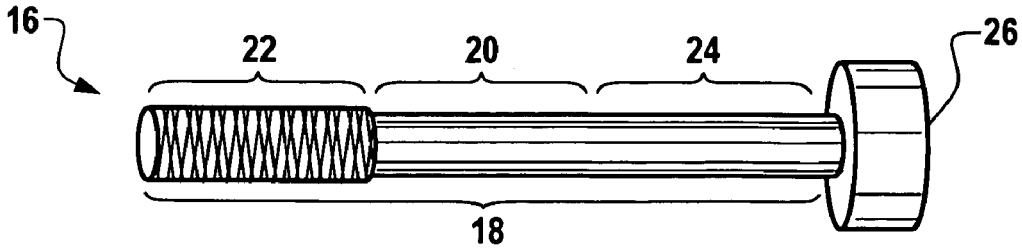
Figure 11:
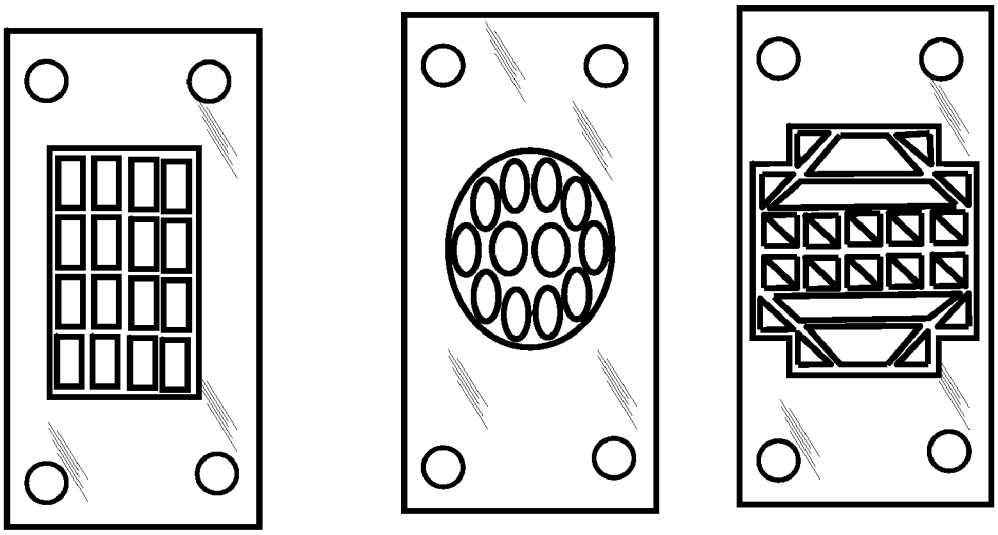

In FIG. 11*a*, the first end 22 may even have a texture region 28. The texture region 28 may have etching, grooves, slots, ribs, beads, coatings, particles, a knurled pattern or combination thereof to provide improved grip by increasing the friction between the contact surfaces of adjacent pins of the one or more pins 16. The texture region 28 may extend partially or entirely over the shaft 18. Additionally, striker plate 10 may contain a variety of pins within the one or more pins 16 with some having the texture region 28, some lacking the textured regions 28, some of different types of texture region 28 or combinations thereof. Additionally, the cross sectional shape of the individual pins of the one or more pins 16 may differ depending on the application, for example, the cross-section may be circular, rectangular (e.g., FIG. 11 *e* ), oval (e.g., FIG. 11 *f* ), square, polygonal (e.g., FIG. 11 *g* ),or combinations thereof (e.g., FIG. 11 *g* ).

Figure 12:
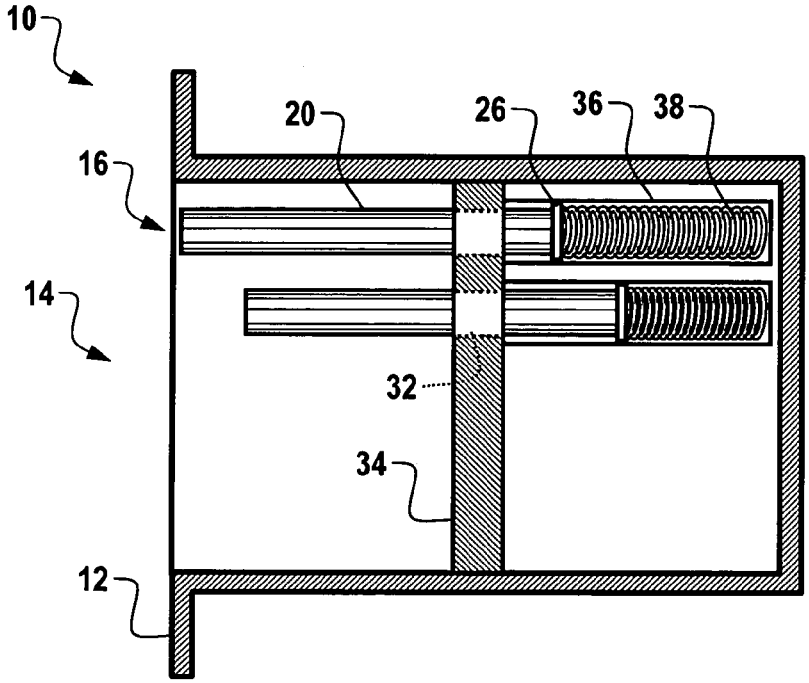
FIG. 12 is a side view of the apparatus shown in FIG. 1.
Figure 13:
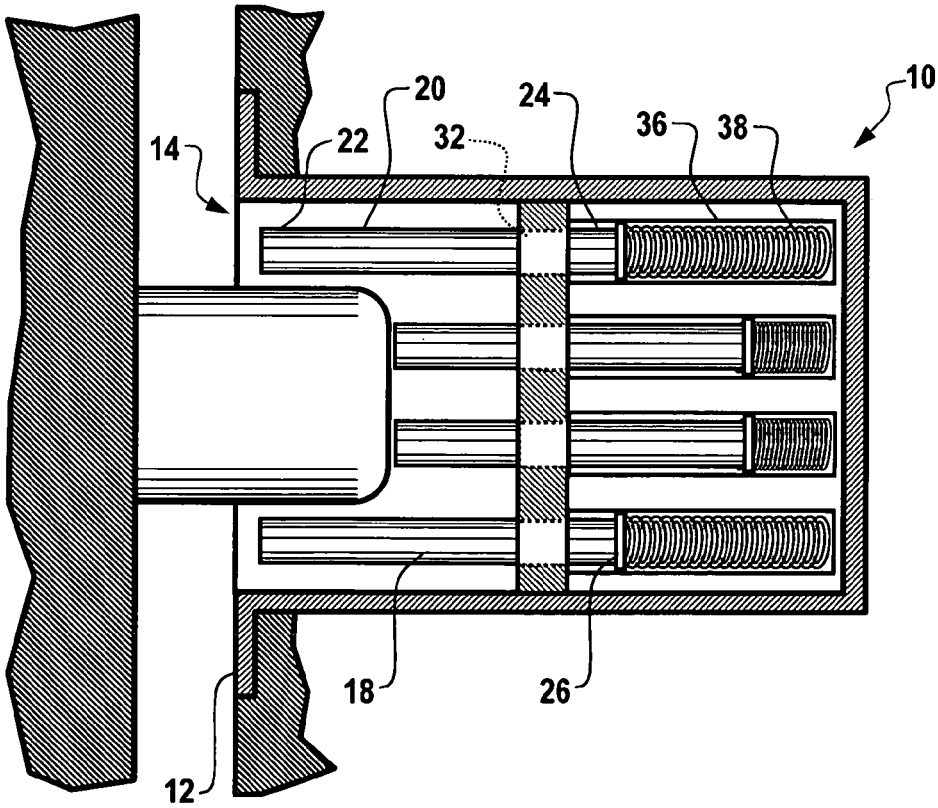
FIG. 13 is a side view of the apparatus shown in FIG. 1 in use.
Figure 14:
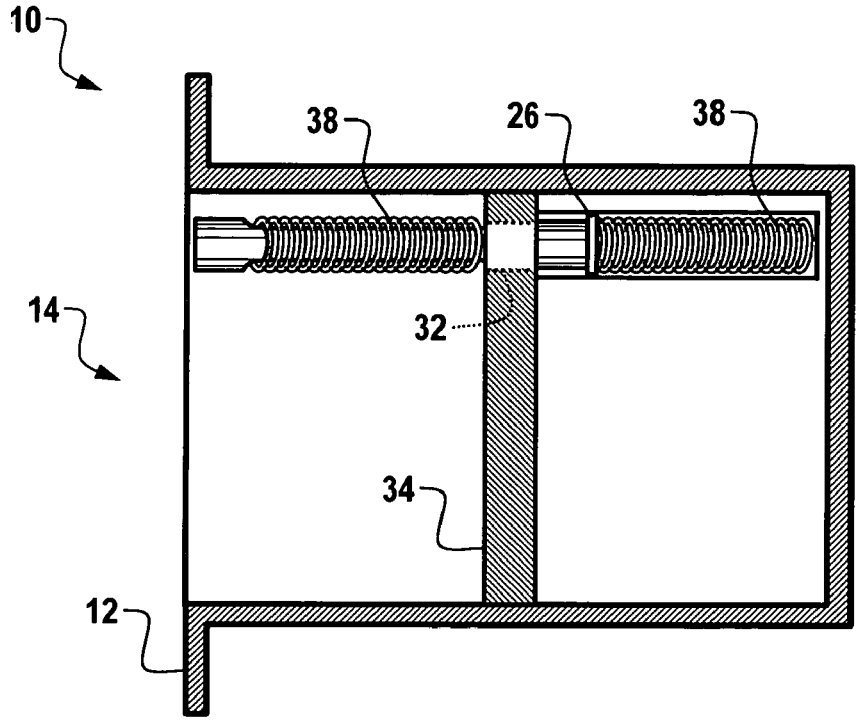
FIG. 14 is a side view of another embodiment of the apparatus shown in FIG. 1.

Now referring to FIGS. 12, 13 and 14 different embodiments of a simplified illustration of FIG. 1 insofar as fewer pins are illustrated for the sake of clarity.

Again referring to FIGS. 12, 13 and 14 the retaining mechanism 26 serves to retain the second end 24 of each of the one or more pins 16 on one side of the frame 34 through having a diameter larger than the housing aperture 32, whereby the second end 24 cannot pass through the housing aperture 32. Frame 34 is attached to the internal region 30 of the housing 12. The frame 34 may be a plate fitted to the housing 12 having one or more housing apertures 32. The one or more housing apertures 32 receive the corresponding one or more pins 16 allowing the one or more pins 16 to be arranged in the desired pattern depending on the particular application. The housing aperture 32 is generally the diameter of the middle section 20 of the shaft 18, however other embodiments may use housing aperture 32 of different sizes.

Again referring to FIGS. 12, 13 and 14 the retaining mechanism 26 serves to retain the second end 24 of each of the one or more pins 16 on one side of the frame 34 through having a diameter larger than the housing aperture 32, whereby the second end 24 cannot pass through the housing aperture 32. Frame 34 is attached to the internal region 30 of the housing 12. The frame 34 may be a plate fitted to the housing 12 having one or more housing apertures 32. The one or more housing apertures 32 receive the corresponding one or more pins 16 allowing the one or more pins 16 to be arranged in the desired pattern depending on the particular application. The housing aperture 32 is generally the diameter of the middle section 20 of the shaft 18, however other embodiments may use housing aperture 32 of different sizes.

As seen in FIGS. 12, 13 and 14 the frame 34 may be an integrated portion of the housing 12 having one or more housing apertures 32 that create cavities 36 to accommodate the one or more pins 16, whereby each pin of the one or more pins 16 is separated and may move independently of each other pin in the one or more pins 16. The cavities 36 are recessed areas in the frame 34 to accommodate the movement of the one or more pins 16. The frame 34 may alternatively have sheaths or sleeves to fit into the one or more housing apertures 32 to form cavities 36 to accommodate the movement of the one or more pins 16. The sheaths or sleeves may be used to isolate the interaction of the individual pins of the one or more pins 16. The frame 34 may be permanently attached to the housing (e.g., molded, cast, welded, riveted, glued or similarly affixed) or removably affixed (e.g., screwed, riveted, fitted frictionally or similarly held) to the housing 12. A bias mechanism 38 is positioned to contact the each pin of the one or more pins 16. In one embodiment, the one or more pin 16 itself may be made or include a spring, coiled compression spring, comprisable material, elastomeric material, polymeric material, resilient material or combinations thereof.

As demonstrated in FIG. 12, the bias mechanism 38 is fitted into the cavities 36 of the frame 34 so that the bias mechanism 38 contacts the retaining mechanism 26 of the second end 24 of each of the one or more pins 16. In some embodiments, the bias mechanism 38 is separated from other bias mechanism 38 by the cavities 36, sheath or sleeve to allow independent operation of the one or more pins 16. Other embodiments include a bias mechanism 38 that does not have dividers or cavities to separate the individual bias mechanism 38 and/or the one or more pins 16.

Now referring to FIG. 13, a side view of the striker plate 10 having one bias mechanism 38 and engaging a throw bolt in operation. A throw bolt is extended into the open end 14 of the striker plate 10. As the throw bolt is extended into the one or more pins 16, a force is applied to the first end 22 of one or more of the one or more pins 16. The movement of one or more of the one or more pins 16 results in the middle portion 20 of the shaft 18 sliding through the housing apertures 32 toward the second end 24 and each into cavities 36. The arrangement of the one or more pins 16 allows the movement of each pin of the one or more pins 16 independently, e.g., one pin 16 may have force acting on it while the adjacent pin 16 does not, thus one pin 16 moves while the other pin 16 remains stationary. The sliding of one or more of the one or more pins 16 into cavities 36 results in compression of the bias mechanism 38. The one or more pins 16 surrounding the throw bolt are not depressed, as there is no force acting on them and they remain biased away from the frame 34 by the bias mechanism 38. The remaining one or more pins 16 surrounding the door latch or deadbolt cause the door latch or deadbolt to be wedged inside the one or more pins 16. When force is applied to the door latch or deadbolt surrounded by the one or more pins 16 the force is transferred to the adjacent pins of the one or more pins 16 and into the housing 12 and the doorframe, thus resisting movement. When the force is removed, the bias mechanism 38 decompresses, which results in the middle portion 20 of the shaft 18 sliding through the housing apertures 32 toward the open end 14, until the movement of the shaft 18 is stopped by the contact of the retaining mechanism 26 and the housing 32.

FIG. 14 demonstrates another embodiment of the striker plate 10 including a housing 12 having an internal region 30 and an open end 14 exposing one or more pins 16. Each pin of the one or more pins 16 has a shaft 18 having a middle portion 20, a first end 22 and a second end 24. The one or more pins 16 are independently slidably positioned to penetrate within the housing 12. The first end 22 of the one or more pins 16 extends to the open end 14. The first end 22 of the one or more pins 16 including a region of greater diameter than the middle portion 20 of the shaft 18. While the middle portion 20 of the shaft 18 extends into the internal region 30 and through housing aperture 32 of frame 34. The second end 24 of the one or more pins 16 extends into the internal region 30 of the housing 12 and has a retaining mechanism 26 located thereon.

Again referring to FIGS. 12, 13 and 14, the retaining mechanism 26 serves to retain the second end 24 of the shaft 18 on one side of the frame 34 through having a portion of second end 24 have a greater diameter than the housing aperture 32, whereby the second end 24 cannot pass through the housing aperture 32. The retaining mechanism 26 may be an integrated portion of second end 24, e.g., grooves, slots, ribs, beads, particles, notches, bulges or similar mechanism known in the art. Alternatively, the retaining mechanism 26 may be attached to a portion of the second end 24, e.g., a cap, a plate, a bolt, a clip, or similar mechanism known in the art. The attachment may be through a permanent mechanism (e.g., glue, epoxy, weld or the like) or a frictional fitting. The frame 34 is attached to the internal region 30 of the housing 12.

The frame 34 may be a plate fitted to the housing 12 having one or more housing apertures 32. Alternatively, the frame 34 may be an integrated portion of the housing 12 having one or more housing apertures 32 to accommodate the one or more pins 16. The housing apertures 32 may be arranged in different configurations depending on the particular application.

In some embodiments, the housing apertures 32 are separated from other housing apertures 32 in channels or cavities 36, which are void regions that extend the aperture into a the housing material to accommodate the shaft 18 thus allowing independent operation of the one or more pins 16. The cavities 36 structure may include many different structures known to persons of ordinary skill in the art including channels, tunnels, sheaths, sleeves and the like. A bias mechanism 38 is positioned to contact the first end 22 of the one or more pins 16 and the frame 34, wherein the bias mechanism 36 is positioned between the open end 14 an the frame 34. The bias mechanism 38 may be in the form of a spring, coiled compression spring, comprisable material, elastomeric material, polymeric material, resilient material or combinations thereof.

Figure 15:
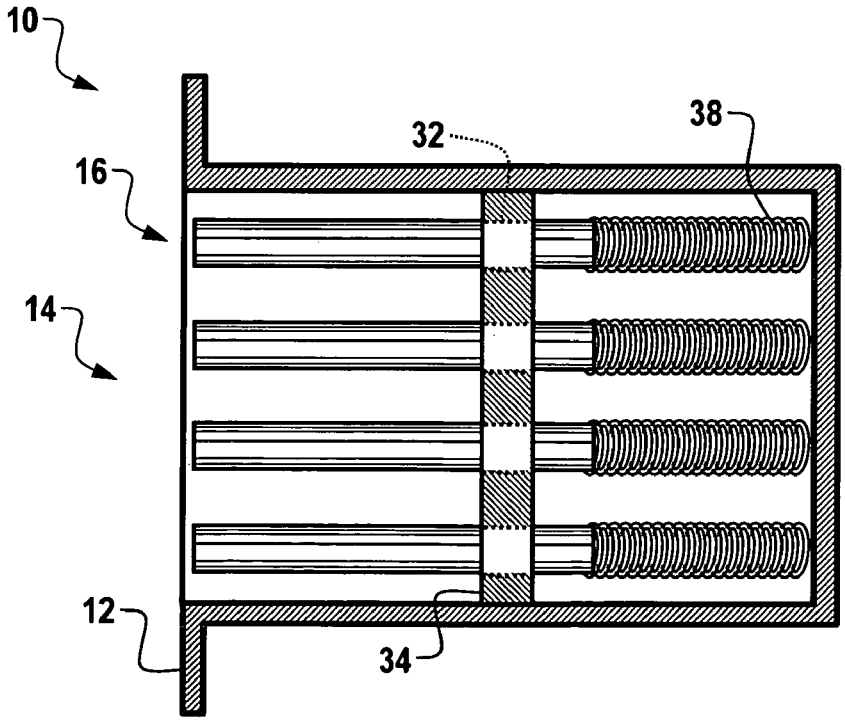
FIG. 15 is a side view of another embodiment of the apparatus shown in FIG. 1.

Referring to FIG. 15, yet another embodiment of the present invention is a striker plate 10 having a housing 12 having an open end 14 and one or more housing apertures 32. The recessed area in the frame 34 accommodates the movement of the one or more pins 16. A bias mechanism 38 is positioned to contact the each pin of the one or more pins 16. In one embodiment, the pin of the one or more pins 16 itself may be made or include a spring, coiled compression spring, comprisable material, elastomeric material, polymeric material, resilient material or combinations thereof.

In some embodiments, the housing apertures 32 are separated from other housing apertures 32 by the removal of material of the aperture to extend the aperture to accommodate the shaft 18 thus forming a channel or cavities 36 to allow independent operation of the one or more pins 16. The cavities 36 may include many different structures known to persons of ordinary skill in the art including channels, tunnels, sheaths sleeves and the like.

FIG. 14 shows another embodiment of the striker plate 10 having a first bias mechanisms and a second bias mechanisms 38. The first bias mechanism 38 is positioned to contact the first end 22 of the shaft 18 and the frame 34. The first bias mechanism 38 is held in position due to the restricted movement of the first bias mechanism 38 caused by the enlarged portion of first end 22 and the frame 34, wherein the first bias mechanism 38 is positioned between the open end 14 an the frame 34. A second bias mechanism 38 is positioned to contact the retaining mechanism 26 of the second end 24 of the shaft 18. The bias mechanism 38 is fitted into the cavities 36 of the frame 34 so that the bias mechanism 38 contacts the retaining mechanism 26 of the second end 24 of the shaft 18.

Other embodiments are contemplated that include a bias mechanism 38 that does not have dividers or cavities to separate the individual bias mechanism 38 and/or the one or more pins 16. Additionally, the present invention may use different combinations of bias mechanisms 38 and compression rates, including multiple bias mechanisms 38 in concentric arrangements or in sequential arrangements. The bias mechanism 38 may be in the form of a spring, coiled compression spring, comprisable material, elastomeric material, polymeric material, resilient material or combinations thereof. The bias mechanism 38 may also be incorporated in or on the pin. This may be accomplished through inserting a bias mechanism 38 into a hollow pin which is than positioned through the housing aperture 32 and onto an inserting member (not shown) incorporated into the housing 30, wherein the bias mechanism 38 is compressed against the inserting member (not shown) within the hollow pin.

One embodiment of the present invention of the present invention includes a striker plate 10 including a housing 12 having an internal region 30 and an open end 14 exposing one or more pins 16. The one or more pins 16 are independently slidably positioned to penetrate within the housing 12. Each pin of the one or more pins 16 has a shaft 18 having a middle portion 20 and a first end 22 and a second end 24, wherein the length of the shaft 18 is about 1.25 inches. The first end 22 of the one or more pins 16 extends to the open end 14. While the middle portion 20 of the shaft 18 extends into the internal region 30 and through housing aperture 32, which is about the size of the middle portion 20. The second end 24 of the shaft 18 extends into the internal region 30 of the housing 12 and has a metal cap 26, which has a diameter greater than the diameter of the housing aperture 32, located thereon. The metal cap 26 serves to retain the second end 24 of the shaft 18 on one side of the frame 34 through having a diameter larger than the housing aperture 32, whereby the second end 24 cannot pass through the housing aperture 32. The frame 34 is constructed from a composite material having housing aperture 32 extending through frame 34 a sufficient distance to accommodate the shaft 18. In some embodiments, this may be created through drilling, etching, molding or combinations thereof. The one or more housing apertures 32 receive the corresponding one or more pins 16 allowing the one or more pins 16 to be arranged in a closely packed pattern, whereby each pin of the one or more pins 16 is separated and may move independently of each other pin in the one or more pins 16. The housing aperture 32 is used to isolate the interaction of the individual pins of the one or more pins 16. A spring 38 is positioned to contact metal cap 26 of each pin of the one or more pins 16. The spring 38 is fitted into the cavities 36 of the frame 34 so that the spring 38 contacts the metal cap 26 of the second end 24 of each of the one or more pins 16.

Figure 16:
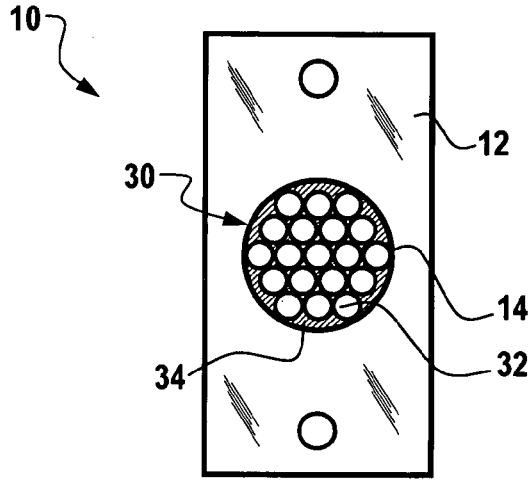
FIG. 16 is a front view of a portion of the apparatus shown in FIG. 1.
Figure 17A:
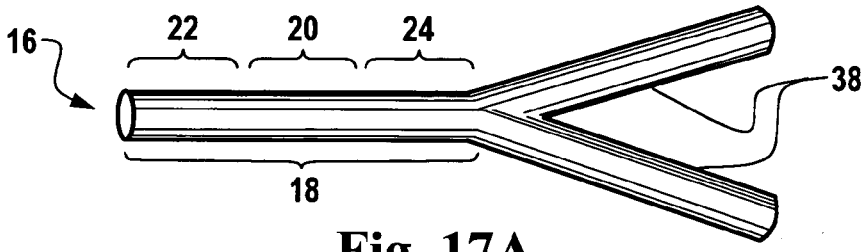
FIGS. 17*a-g* are side views of different embodiments of the pins shown in FIG. 1, coupled to a bias mechanism.
Figure 17B:
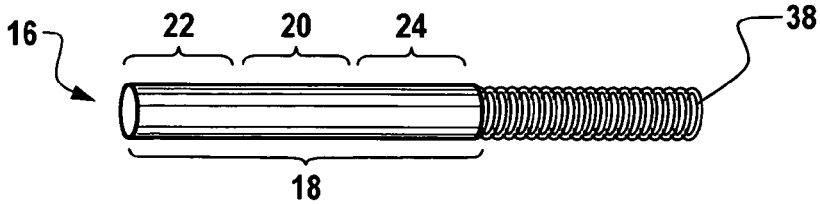
Figure 17C:
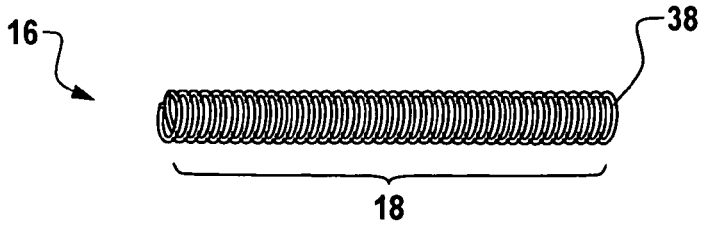
Figure 17D:
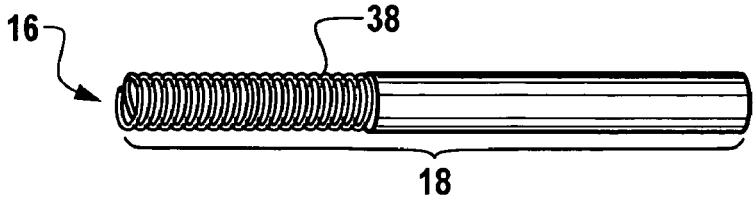
Figure 17E:
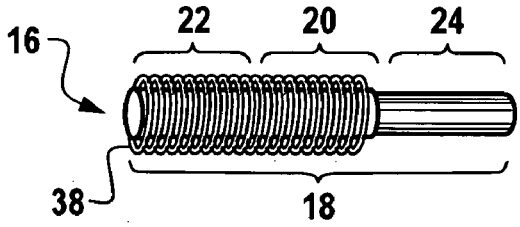
Figure 17F:
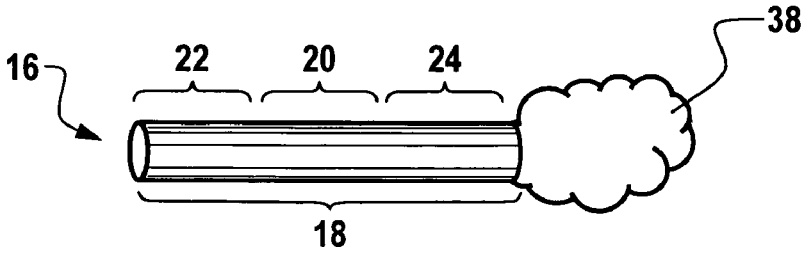
Figure 17G:
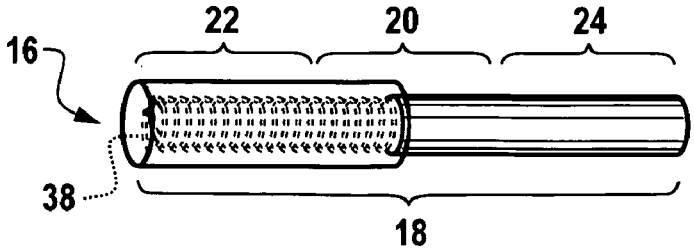

FIG. 16 is a front view of the striker plate 10 including the housing 12 having one or more housing aperture 32. The housing 12 may have housing aperture 32 that extend through housing 12 a sufficient distance to accommodate the one or more pins 16. In some embodiments, this may be created through drilling, etching, molding or combinations thereof. The one or more housing apertures 32 are arranged in a closely packed pattern and designed to receive the corresponding one or more pins (not shown), whereby each pin of the one or more pins (not shown) is separated and may move independently of each other pin in the one or more pins (not shown). The housing aperture 32 is used to isolate the interaction of the individual pins of the one or more pins (not shown).

Figure 18A:
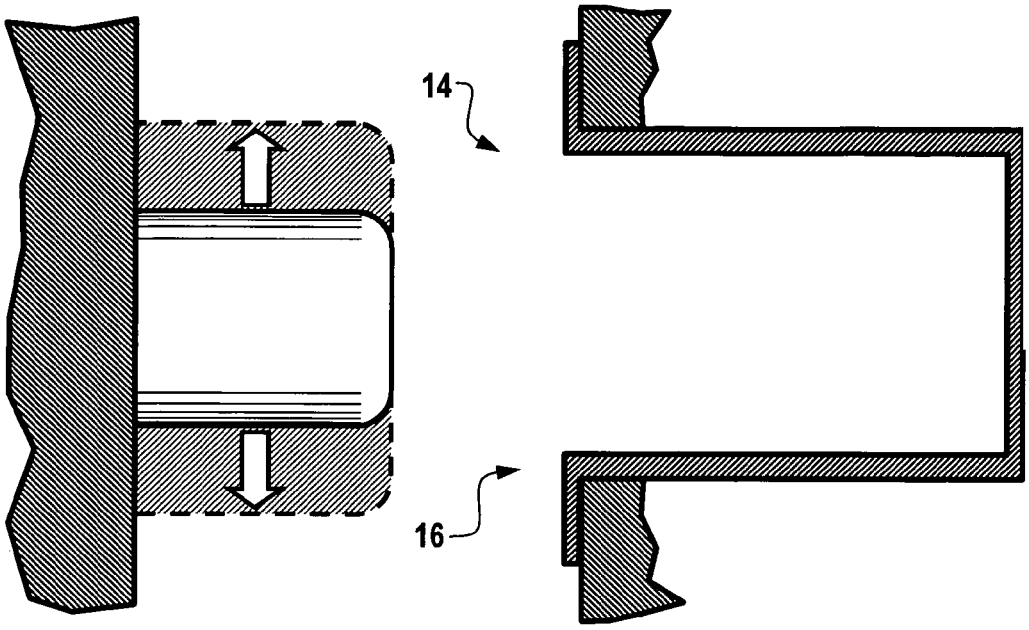
FIG. 18 illustrates certain features of a self-adjusting striker plate in use according to an embodiment of the present invention.

With reference to FIGS. 17*a-g* are side views of different embodiments of a portion of the apparatus 10 shown in FIG. 1. FIGS. 17*a-g* are different embodiments of representative pins of one of the one or more pins 16 coupled to bias mechanism 38 of a striker plate (not shown). Each of the one or more pins 16 includes a shaft 18 having a middle portion 20 and a first end 22 and a second end 24. The second end 24 may have a retaining mechanism 26. In some embodiments, each pin of the one or more pins 16 may be coupled to a bias mechanism 38 having a comprisable material, elastomeric material, polymeric material, resilient material or combinations thereof, e.g., FIGS. 17*a* and 17*f*. Whereas, other embodiments, may couple each pin of the one or more pins 16 to a bias mechanism 38 employing a spring, coiled spring or compression spring as a bias mechanism 38, e.g., FIGS. 17*b*, 17*c*, 17*d* and 17*g*. While still other embodiments may, use each pin of the one or more pins 16 coupled to a bias mechanism 38 that uses a combination of a spring and a comprisable material, elastomeric material, polymeric material or resilient material, e.g., FIG. 17*e*. Additionally, the striker plate 10 may use a combination of different pins and biasing mechanisms in a single unit. FIG. 18 is a side view of a striker plate in use. FIG. 18*a* demonstrates the position of the throw bolt and the conventional striker plate. In response to movement of the door, doorframe, foundation or combinations thereof, the throw bolt may be at a position higher or lower than the opening in the conventional striker plate. This movement results in misalignment of the relatively small hole of the striker plate and the door latch and/or the dead bolt latch. The misalignment often causes the door to be difficult or even impossible to secure.

Figure 18B:
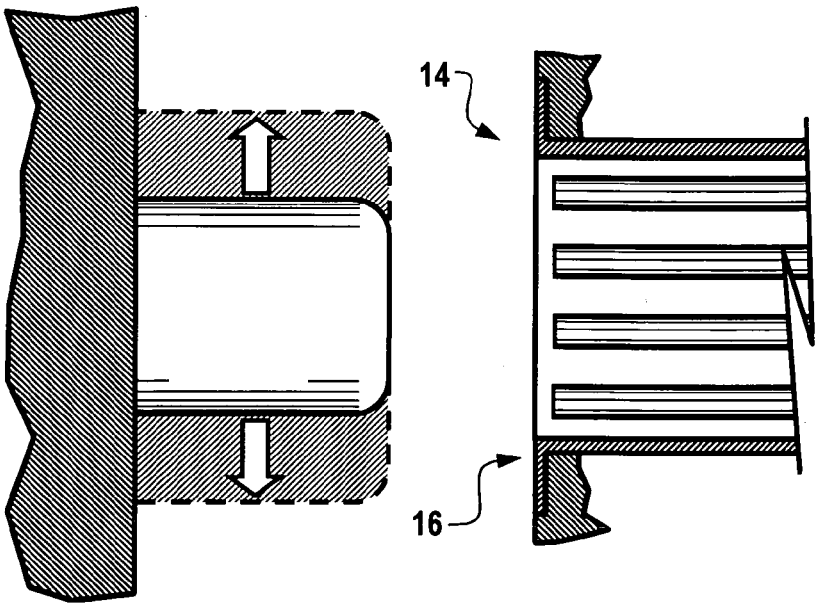

FIG. 18*b* demonstrates the position of the throw bolt and one embodiment of the striker plate 10 including a housing 12 having an internal region 30 and an open end 14 exposing one or more pins 16. In response to movement of the door, doorframe, foundation or combinations thereof, the throw bolt may be at a different position. The different positions of the throw bolt may be accommodated within the housing 12 and the throw bolt would contact one or more of the pins 16. Therefore, allowing the door to be secured.

Figure 19:
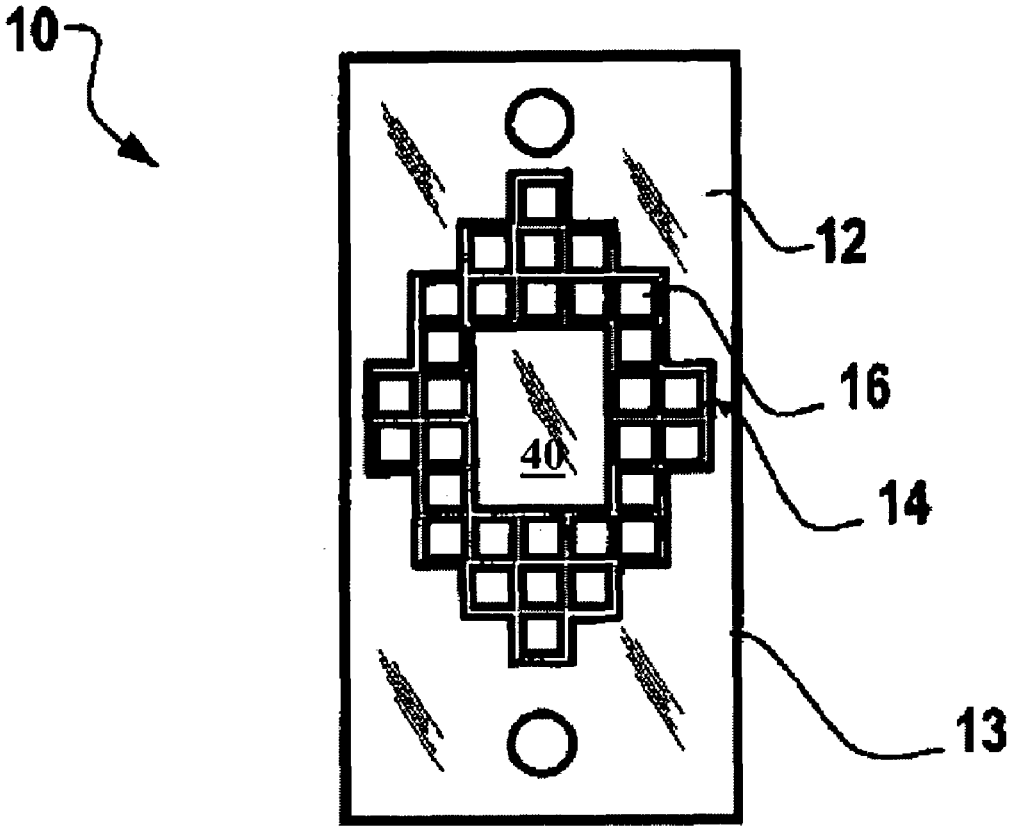
FIG. 19 is a front view of another embodiment of the self-adjusting striker plate of the present invention.

FIG. 19 is a front view of another embodiment of the self-adjusting striker plate 10. The housing 12 has an opening 14 exposing one or more pins 16. A lip 13 may be incorporated into the housing 12 at opening 14 and directs or pushes the latch toward the opening 14. The shape of the housing 12 may be varied to accommodate different structures and door jams. For example, the profile of the housing 12 may be rectangular, square, circular, free formed, polygonal, or combination thereof. Similarly, the open end 14 exposing one or more pins 16 may have a variety of shapes, e.g., rectangular, square, circular, free formed, polygonal, or combination thereof. Likewise, the one or more pins 16 may have a variety of shapes and textures. The embodiment illustrated in FIG. 19 depicts a polygonal opening 14 exposing numerous pins 16 with one or more larger pins 40. In this embodiment, the one or more larger pins 40 are positioned in the middle of the opening 14 and the one or more pins 16. The one or more larger pins 40 may be positioned anywhere about the opening 14, e.g., the top, the bottom or the side. FIG. 19 is illustrative only and the shape of the open end 14, the housing 12, one or more larger pins 40 and one or more pins 16 may be any shape and size desired and it will be obvious for the skilled artisan to use the present application to create an infinite number of combinations. Similarly, the number of the one or more pins 16 may be any desired number or combination. Furthermore, the self-adjusting striker plate 10 may have a side plate (not shown) that extends generally parallel to the housing 12 (see FIG. 20) and closer to the edge of the door frame threshold to maximize the mechanical strength and further protect and secure the self-adjusting striker plate 10.

Figure 20:
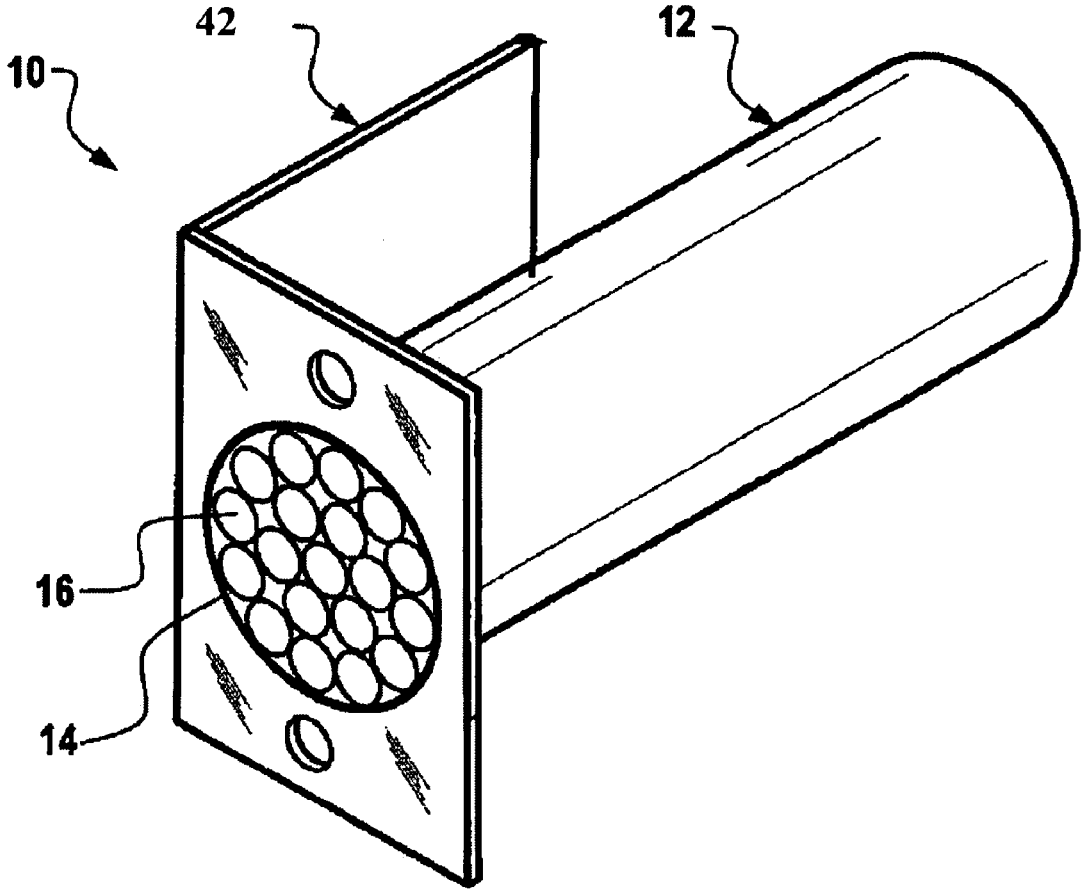
FIG. 20 is a perspective view that illustrates another embodiment of a striker plate of the present invention.

FIG. 20 is a perspective view that illustrates another embodiment of the striker plate of the present invention. The housing 10 includes an opening at the opening 14 that may include a lip (not shown) that directs or pushes the latch toward the opening 14. The striker plate 10 includes the housing 12 having an opening 14 exposing one or more pins 16. The one or more pins 16 may have a cross section that is generally circular; however, the one or more pins 16 may have a cross section that is any shape, e.g., circular, oval, square, rectangular, triangular, polygonal or combination thereof. The self-adjusting striker plate 10 also includes a side plate 42 that extends generally parallel to the housing 12 and may be positioned by the edge of the threshold to maximize the mechanical strength of the lock system and further protects and secures the self-adjusting striker plate 10. The side plate 42 may be attached to any portion of the striker plate 10 For example, the side plate 42 may be attached to the housing 12 and to the wall or studs to provide added security. The side plate 42 may extend any length desired and side plate 42 may be longer than the housing 12, shorter than the housing 12 or the same length as the housing 12. In addition, the side plate 42 may be the height of the housing 12 or any desired size. Generally, the housing 12 will be positioned in the opening of the door jam. As the housing 12 is not generally positioned in the center of the door jam a weakness is created in the door jam. The present invention provides a side plate 42 that may be used to add strength to the door jam. In some embodiments, a portion of the door jam fits between the side plate 42 and the housing; however, in other embodiments the side plate 42 may replace some or all of the structural components of the door jam. In some embodiments, the exterior surface may have to be altered to accommodate or to conceal the side plate 42.

Figure 21A:
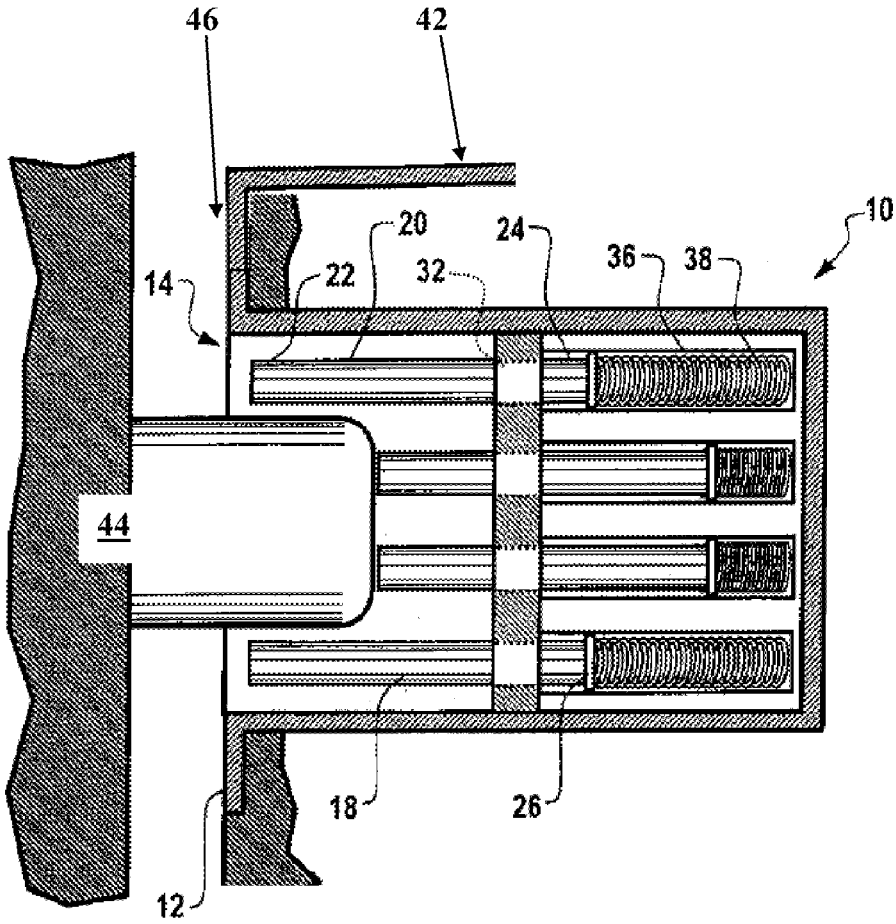
FIG. 21*a*, a cross sectional view of the striker plate of the present invention engaging a throw bolt.
Figure 21B:
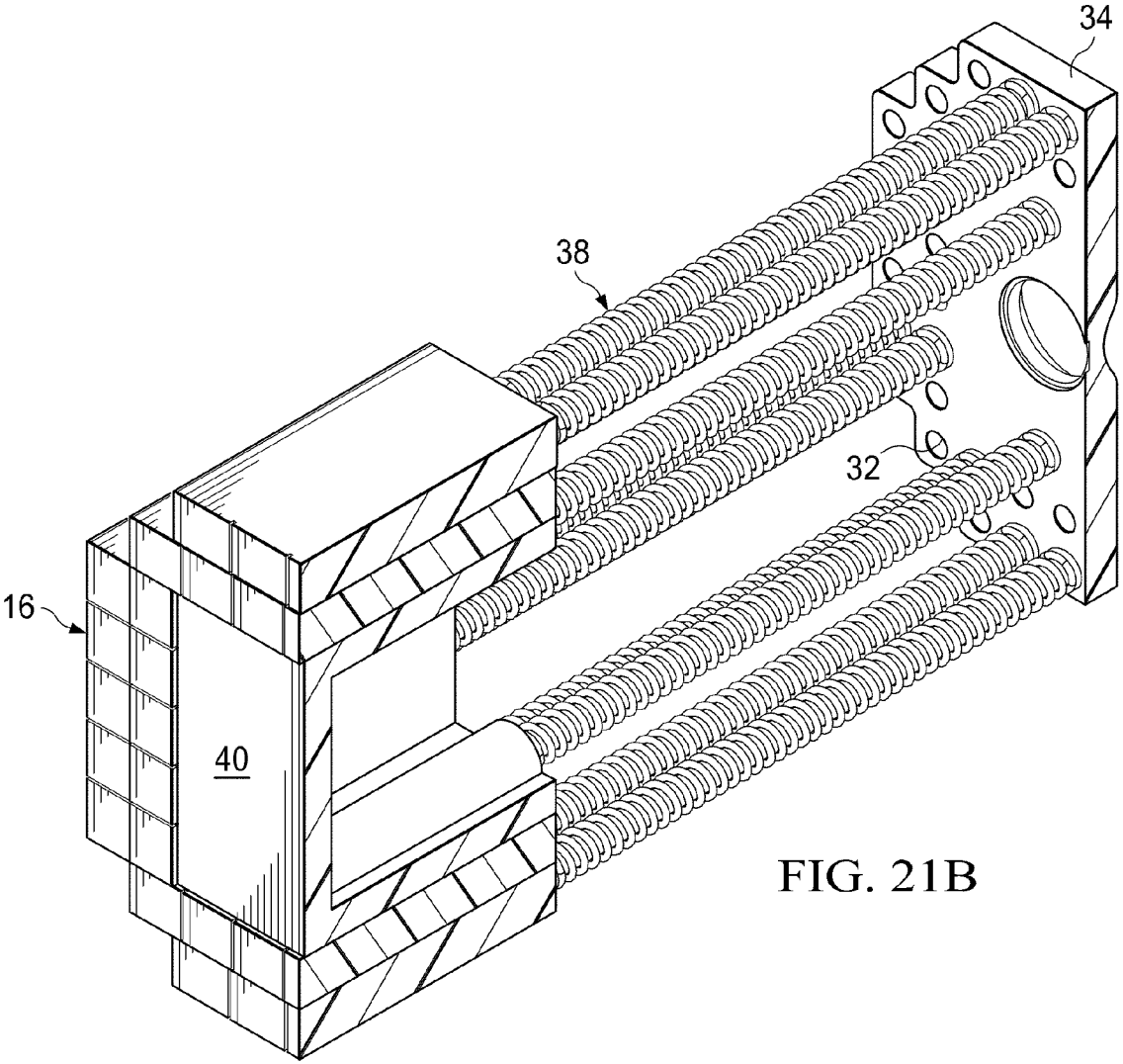
FIGS. 21*b* and 21*c* are cross sectional views of the striker plate of the present invention having a larger central pin and two pins.
Figure 21C:
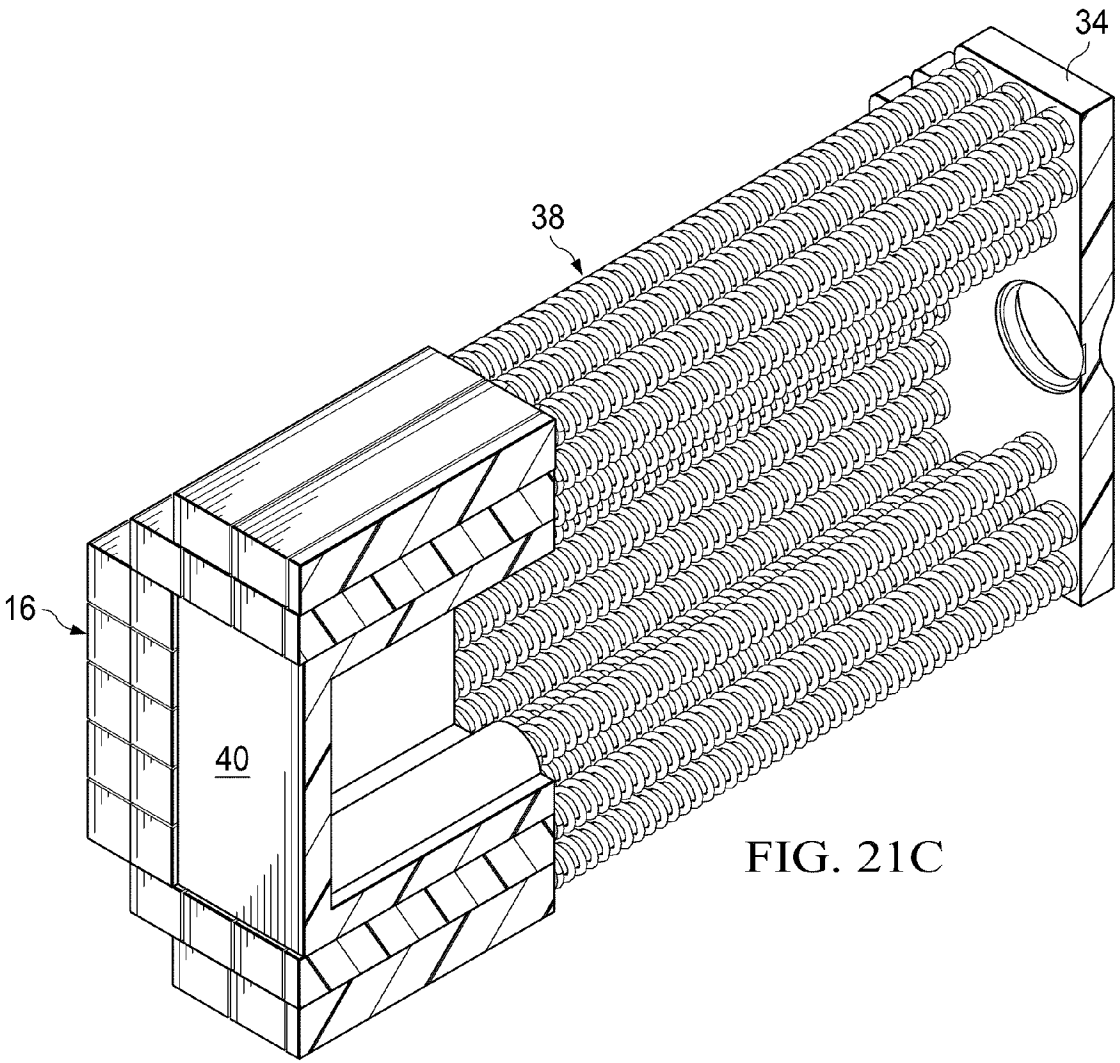

Now referring to FIGS. 21*a*, 21*b* and 21*c* cross-sectional view of the striker plate 10 having one or more bias mechanisms 38 and engaging a throw bolt 44. FIGS. 21*b* and 21*c* also illustrate the one or more larger pins 40 and two more pins attached thereto. In operation the throw bolt 44 is extended into the open end 14 of the striker plate 10. As the throw bolt 44 is extended into the one or more pins 16, a force is applied to the first end 22 of the one or more pins 16. The movement of the one or more pins 16 results in the middle portion 20 of the shaft 18 sliding through the housing apertures 32 toward the second end 24 and each into cavities 36. The arrangement of the one or more pins 16 allows the movement of each of the one or more pins 16 independently, e.g., one pin 16 may have forces acting on it while the adjacent pin 16 does not, thus one pin 16 moves while the other pin 16 remains stationary. The sliding of one or more of the one or more pins 16 into cavities 36 results in compression of the bias mechanism 38. The one or more pins 16 surrounding the throw bolt 44 are not depressed, as there is no force acting on them and they remain biased away from the frame 34 by the bias mechanism 38. The remaining one or more pins 16 surrounding the door latch or deadbolt cause the door latch or deadbolt to be wedged inside the one or more pins 16. When force is applied to the door latch or deadbolt surrounded by the one or more pins 16 the force is transferred to the adjacent pins of the one or more pins 16 and into the housing 12 and the doorframe, thus resisting movement. When the force is removed, the bias mechanism 38 decompresses, which results in the middle portion 20 of the shaft 18 sliding through the housing apertures 32 toward the opening 14, until the movement of the shaft 18 is stopped by the contact of the retaining mechanism 26 and the housing 32. A side plate 42 is attached to the housing 12 at the opening 14. The housing creates a cavity 46 that allows the frame of the door jam to be positioned therein. Some embodiments include a second side plate (not shown) attached to the opposite side of the housing 12 at the opening 14. Still other embodiments include a member that extends through the cavity 46 and attaches to the doorframe. The side plate 42 is secured to the housing 12 and may be longer than the housing 12, shorter than the housing 12 or the same length as the housing 12. Similarly, the side plate 42 may be the height of the housing 12, smaller than the housing 12 or larger than the housing 12. The side plate 42 may be integrated with the housing 12, or it may be attached permanently or semi-permanently to the housing 12. In addition, the striker plate 10 may include a cavity positioned between the housing 12 and the side plate 42.

Figure 22:
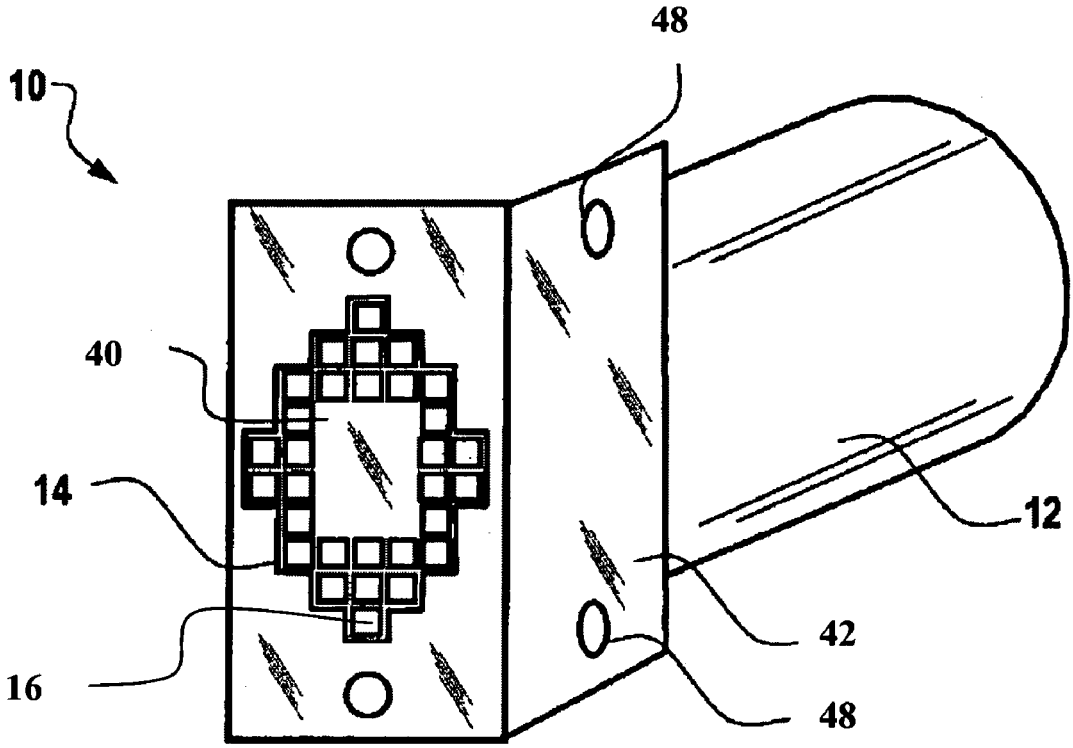
FIG. 22 is a perspective view that illustrates another embodiment of a striker plate of the present invention.

FIG. 22 is a perspective view that illustrates another embodiment of the striker plate 10 of the present invention. The striker plate 10 includes the housing 12 having an opening 14 exposing one or more larger pins 40 and/or one or more pins 16. The one or more pins 16 have a square, rectangular, triangular, polygonal or combination thereof. The self-adjusting striker plate 10 includes a side plate 42 that extends generally parallel to the housing 12 and closer to the edge of the threshold to maximize the mechanical strength and further protect and secure the self-adjusting striker plate 10. The side plate 42 may be attached to the housing 12, the opening 14 or a combination thereof. In addition, the side plate 42 includes side retaining apertures 48. For example, the side plate 42 may be attached to the housing 12 to provide added security. The side plate 42 may extend any length desired and side plate 42 may be longer than the housing 12, shorter than the housing 12 or the same length as the housing 12. In addition, the side plate 42 may be the height of the housing 12 or any desired size. One or more additional side plates (not shown) may be positioned perpendicular, parallel or both in relation to the side plate 42 and parallel housing 12, e.g., 1, 2 or 3 additional side plates may be added. The side plates are not restricted in shape or size and may independently be of any shape and or size.

Generally, the housing 12 will be positioned in the opening of the door jam. As the housing 12 is not generally positioned in the center of the door jam a weakness is often created in the door jam. The present invention provides a side plate 42 that is used to add strength at the opening in the door jam. In some embodiments, a portion of the door jam fits between the side plate 42 and the housing; however, in other embodiments the side plate 42 may replace the structural component of the door jam. In some embodiments, the exterior surface must be altered to accommodate the side plate 42 in a concealed manner on one or multiple sides.

The side plate 42 may be attached to the housing 12 by any manner known to the skilled artisan including but not limited to welding, machining, casting, molding, sintering, epoxying, screwing, bolting, gluing or combination thereof. The housing may be a variety of thickness depending on the needs of the particular application. Any of the members used to construct the present invention may be individually constructed of materials that are 0.05, 0.1, 0.2, 0.3, 0.4, 0.5, 0.6, 0.7, 0.8, 0.9 or 1.0 inches in thickness. In addition, the skilled artisan will recognize that the dimensions may be of any increment between 0.05 and 1.5 inches, e.g., 0.125 thickness for the side plate. Each wall of the housing or lip may be constructed from materials having a thickness between 0.01 inches and more than an inch. The striker plate 10 may have 2, 3, 4, 5, 6, 7, 8, 9, 10, 11 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60 or more pins 16 of one or more sizes and shapes.

The present invention may be used in conjunction with screws and bolts of different threads (e.g., deep, shallow, medium or combination thereof), sizes, heads (e.g., square, Phillips, flat, bolt or combination thereof), shank, length and so forth. For example, the screws may be #4 screws, #6 screws, #8 screws, #10 screws, #12 screws, #14 screws or any size between #1 screws and #20 screws. The screw may have serrated pilot threads to eliminate pre-drilling and/or deep, sharp threads, to hold tightly. Another example of screws that may be used with the present invention are illustrated in U.S. Pat. No. 7,037,059, entitled, "Self-tapping Screw for Composite Materials" relevant portions incorporated herein by reference. The patent teaches a screw having threads of the two thread sections have an opposite pitch and the pitch of the threads of the multiple screw-thread is greater than the pitch of the single screw-thread of the thread section near the head of the screw.

The striker plate 10, the housing 12, the internal region 30 and the one or more pins 16 may individually be constructed entirely or in part from metals, alloys, plastics, composites, coatings or other suitable materials or combinations thereof. Common materials include steel, chromalloy, iron, stainless steel, brass, zinc, copper, nickel, titanium, aluminum, alloys and mixture thereof. In addition, the striker plate 10 or any portion thereof may be coated, plated or covered with other materials known to the skilled artisan, e.g., chrome plated steel. Furthermore, the present invention may be coated, plated, finished or textured as desired.

In addition, studies have shown that a contributing factor to lock failure is the partial extension of the throw bolt. The present invention may include an indicator that reports the extension of the throw bolt. In operation, the throw bolt 44 when fully engaged will result in a connection being made that triggers the indicator. Alternatively, the indicator could be active until the throw bolt 44 is fully engaged wherein the connection being made deactivates the indicator. In some embodiments, the indicator is a visible indicator (e.g., light, bar, etc.) and in other embodiments the indicator is an audible indicator (e.g., a buzz, a click, a hum, a noise, a specific recording, a bark, a growl or other sound). To accomplish this, the present invention may incorporate an indicator (e.g., LED, bulb or other indicator known to the skilled artisan) in communication with a power source (e.g., a battery, an internal source, an external source or both) into the present invention. Alternatively, the present invention may incorporate an audible indicator device, e.g., buzzer, speaker, clicker, or other indicator known to the skilled artisan in to the present invention. The present invention may also include both indicators. Furthermore, the present invention may connect to an electrical connection to trigger an alarm, camera, microphone or other device. For example, when the throw bolt 44is fully engaged the alarm is activated. Alternatively, when the throw bolt 44 is not fully engaged a camera is activated. The present invention may also include an indicator device that is mechanical in nature and not requiring a power source. For example as the throw bolt 44 is fully engaged the movement will cause the indicator device to click, pop or chime. This type of device is well known in the art.

The present invention includes a striker plate housing having an opening and one or more pins positioned slidably and toward the opening of the striker plate housing. Each of the one or more pins include an elongated middle portion and a first and second end. The one or more retaining mechanisms are positioned at a first end, a second end, in the middle portion, or combinations thereof, of each of the one or more pins. The one or more pins are packed adjacently, whereby force is transmitted laterally among the adjacent pins.

The one or more biasing mechanisms in contact with each pin of the one or more pins for biasing each of the one or more pins toward the opening to conform to the shape of a throw bolt 44 inserted into the opening. The one or more biasing mechanisms include one or more coiled compression springs.

The present invention includes a method of making a self-adjusting striker plate. The method includes creating an opening in a striker plate housing and creating one or more holes within the opening in a striker plate housing. The method includes positioning one or more pins slidably and toward the opening of the striker plate housing, wherein each of the one or more pins are arranged generally parallel to each other. The method includes contacting the one or more pins with one or more biasing mechanism for biasing each of the one or more pins toward the opening of the striker plate housing, wherein the one or more biasing mechanism comprises one or more coiled compression springs.

The present invention also includes a method of securing a door by positioning a striker plate housing adjacent to a throw bolt. The striker plate housing includes an opening, one or more pins positioned slidably and toward the opening of the striker plate housing. Each of the one or more pins include an elongated middle portion and a first and second end. One or more retaining mechanisms are positioned at a first end, a second end, in the middle portion, or combinations thereof, of each of the one or more pins and the one or more pins are packed adjacently. Therefore, force is transmitted laterally among the adjacent pins one or more biasing mechanisms in contact with each pin of the one or more pins for biasing each of the one or more pins toward the opening to conform to the shape of a throw bolt 44 inserted into the opening. The one or more biasing mechanism include one or more coiled compression springs. The method includes inserting the throw bolt 44 into the striker plate housing, wherein at least a portion of the one or more pins are depressed, whereby the throw bolt 44 is retained.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations can be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A striker plate for a door latch assembly including a throw bolt comprising:

a housing comprising a vertical plate having a front face, a back face and an opening to receive a throw bolt, one or more side plates connected to one edge of the vertical plate such that the one or more side plates are generally perpendicular to the back face to form a cavity about the opening;

a pin frame positioned within the cavity;

a pin set positioned within the pin frame and extending into the opening and positioned to restrict vertical and horizontal movement;

wherein the pin set comprises at least one central pin and four or more adjacent pins in contact with the at least one central pin and arranged to transmit force laterally to restrict the vertical and horizontal movement of the four or more adjacent pins, wherein each of the four or more adjacent pins comprise an adjacent pin cap connected to a pin shaft that extends into the pin frame and wherein the at least one central pin comprises a central pin cap connected to at least two central pin shafts that extend into the pin frame, wherein the central pin cap is larger in diameter than the adjacent pin cap; and a biasing mechanism in contact with each of the at least two central pin shafts and the four or more shafts for biasing toward the opening such that the throw bolt inserted into the opening slides, at least, the at least one central pin away from the throw bolt into the pin frame.

2. The striker plate of claim 1, wherein the throw bolt inserted into the opening comprises a dead bolt, a circular bolt, a gate bolt, a slide bolt, or a bolt.

3. The striker plate of claim 1, wherein at least a portion of a doorframe is positioned between the side plate and the housing.

4. The striker plate of claim 1, wherein each of the four or more adjacent pins have a cross section that is circular, oval, square, rectangular, triangular, polygonal or combinations thereof.

5. The striker plate of claim 1, wherein the at least one central pin has a diameter between 45 and 150% the diameter of the throw bolt.

6. The striker plate of claim 1, wherein the opening is generally circular, oval, square, rectangular, triangular, polygonal or combination thereof.

7. The striker plate of claim 1, wherein the pin frame comprises one or more individual cavities for each pin.

8. The striker plate of claim 1, wherein the biasing mechanism comprises a coiled compression spring.

9. The striker plate of claim 1, wherein the biasing mechanism comprises a coiled compression spring surrounding each of the four or more adjacent pins.

10. A method of securing a door comprising the steps of:

positioning a striker plate housing on a door jam to receive a throw bolt, wherein the striker plate housing comprises a vertical plate having a front face, a back face and an opening to receive a throw bolt, one or more side plates connected to one edge of the vertical plate such that the one or more side plates are generally perpendicular to the back face to form a cavity about the opening; a pin frame positioned within the cavity;

a pin set positioned within the pin frame and extending into the opening and positioned to restrict vertical and horizontal movement; wherein the pin set comprises at least one central pin and four or more adjacent pins in contact with the at least one central pin and arranged to transmit force laterally to restrict the vertical and horizontal movement of the four or more adjacent pins, wherein each of the four or more adjacent pins comprise an adjacent pin cap connected to a pin shaft that extends into the pin frame and wherein the at least one central pin comprises a central pin cap connected to at least two central pin shafts that extends into the pin frame, wherein the central pin cap is larger in diameter than the adjacent pin cap; and a biasing mechanism in contact with each of the at least two central pin shafts and the four or more shafts for biasing toward the opening such that a throw bolt inserted into the opening slides at least the at least one central pin away from the throw bolt into the pin frame positioning the vertical plate on a door jam; and securing the front face to the door jam.

11. The method of claim 10, wherein the biasing mechanism includes a coiled compression spring.

12. A method of making a self-adjusting striker plate for a door latch assembly including a throw bolt comprising the steps of:

creating a housing comprising an opening to receive the throw bolt in a vertical plate having a front face, a back face, one or more side walls connecting the front face and the back face, a pin frame positioned between the front face and the back face and a side plate connected to one edge of the vertical plate to extend parallel to one or more side walls such that the side plate is generally perpendicular to the back face and is generally the height of the vertical plate;

positioning four or more adjacent pins in the pin housing, wherein the four or more adjacent pins comprising at least one larger central pin arranged to transmit force laterally to restrict the vertical and horizontal movement of the four or more adjacent pins, wherein the at least one larger central pin comprising a central pin cap positioned within the opening and at least two central pin shafts that extend into the pin frame and the adjacent pins each comprising an adjacent pin cap positioned within the opening and one or more adjacent pin shafts that extend into the pin frame; and biasing the four or more adjacent pins with a biasing mechanism in contact with each of the adjacent pin shafts and the pin frame toward the opening such that a throw bolt inserted into the opening slides one or more of the adjacent pins away from the throw bolt into the pin housing.

13. A striker plate kit for a door latch assembly including a throw bolt comprising:

a striker plate for a door jam comprising a vertical plate having a front face, a back face and an opening to receive the throw bolt, one or more side plates connected to one edge of the vertical plate such that the one or more side plates are generally perpendicular to the back face to form a cavity about the opening;

a pin frame positioned within the cavity;

a pin set positioned within the pin frame and extending into the opening and positioned to restrict vertical and horizontal movement wherein the pin set comprises at least one central pin and four or more adjacent pins in contact with the at least one central pin and arranged to transmit force laterally to restrict the vertical and horizontal movement of the four or more adjacent pins, wherein each of the four or more adjacent pins comprise an adjacent pin cap connected to an adjacent pin shaft that extends into the pin frame and wherein the at least one central pin comprises a central pin cap connected to at least two central pin shafts that extend into the pin frame, wherein the central pin head is larger in diameter than the adjacent pin head;

a biasing mechanism in contact with each of the at least two central pin shafts and the adjacent pin shaft for biasing toward the opening such that the throw bolt inserted into the opening slides, at least, the at least one central pin away from the throw bolt into the pin frame; and one or more fasteners for securing the striker plate to the door jam.

14. The kit of claim 13, fun her comprising instructions for installation of the kit.

* * * * *